US010065421B2

(12) United States Patent
Iida

(10) Patent No.: US 10,065,421 B2
(45) Date of Patent: Sep. 4, 2018

(54) DEVICE USING A PIEZOELECTRIC ELEMENT AND METHOD FOR MANUFACTURING THE SAME

(71) Applicant: ROHM CO., LTD., Kyoto (JP)

(72) Inventor: Kunio Iida, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 0 days.

(21) Appl. No.: 15/286,620

(22) Filed: Oct. 6, 2016

(65) Prior Publication Data

US 2017/0106652 A1 Apr. 20, 2017

(30) Foreign Application Priority Data

Oct. 16, 2015 (JP) ..... 2015-204694

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1628* (2013.01); *B41J 2/1629* (2013.01); *B41J 2/1631* (2013.01); *B41J 2/1632* (2013.01); *B41J 2/1646* (2013.01); *B41J 2002/14491* (2013.01)

(58) Field of Classification Search
CPC ..... B41J 2/14233; B41J 2/1646; B41J 2/161; B41J 2/1631; B41J 2/1629; B41J 2/1628; B41J 2/1632; B41J 2002/14491
See application file for complete search history.

(56) References Cited

U.S. PATENT DOCUMENTS

2017/0062696 A1* 3/2017 Iida ..... H01L 41/0805

FOREIGN PATENT DOCUMENTS

JP 2015-091668 A 5/2015

* cited by examiner

*Primary Examiner* — Sharon A Polk
(74) *Attorney, Agent, or Firm* — Rabin & Berdo, P.C.

(57) ABSTRACT

An inkjet printing head includes a hydrogen barrier film, covering side surfaces of upper electrodes and piezoelectric films, a portion of an upper surface of each upper electrode, and a portion of an upper surface of a lower electrode, an insulating film, formed above the hydrogen barrier film, upper wiring, formed above the insulating film, connects the upper electrode to a drive circuit, and a lower wiring, formed above the insulating film, connects the lower electrode to the drive circuit. First contact holes, each exposing an upper electrode, and second contact holes, each exposing an extension portion, are formed in the hydrogen barrier film and the insulating film. The upper wirings are connected to the upper surfaces of the upper electrodes via the first contact holes and the lower wiring is connected to an upper surface of the extension portion via the second contact holes.

8 Claims, 33 Drawing Sheets

DEVICE USING A PIEZOELECTRIC ELEMENT AND METHOD FOR MANUFACTURING THE SAME

BACKGROUND OF THE INVENTION

1. Field of the Invention

The present invention relates to a device using a piezoelectric element that uses a piezoelectric element and a method for manufacturing the same.

2. Description of the Related Art

Japanese Patent Application Publication No. 2015-91668 discloses an inkjet printing head. The inkjet printing head of Patent Document 1 includes an actuator substrate (substrate) having a pressure chamber (pressure generating chamber) as an ink flow passage, a movable film (elastic film) formed above the actuator substrate, and a piezoelectric element provided above the movable film. The piezoelectric element includes a lower electrode (lower electrode film) formed above the movable film, a piezoelectric film (piezoelectric layer) formed above the lower electrode film, and an upper electrode (upper electrode film) formed above the piezoelectric film. The inkjet printing head of Japanese Patent Application Publication No. 2015-91668 further includes a nozzle substrate (nozzle plate), bonded to a lower surface of the substrate and having a nozzle opening in communication with the pressure chamber, and a protective substrate bonded to an upper surface of the actuator substrate and covering the piezoelectric element.

SUMMARY OF THE INVENTION

The inventor of preferred embodiments of the present invention described and claimed in the present application conducted an extensive study and research regarding a device using a piezoelectric element and a method for manufacturing the same, such as the one described above, and in doing so, discovered and first recognized new unique challenges and previously unrecognized possibilities for improvements as described in greater detail below.

The present applicant invented an inkjet printing head (hereinafter referred to as the "inkjet printing head according to the reference example"), which, as with the inkjet printing head according to Japanese Patent Application Publication No. 2015-91668, includes an actuator substrate having a pressure chamber, a movable film formed above the actuator substrate, and a piezoelectric element provided above the movable film and constituted of a lower electrode, a piezoelectric film, and an upper electrode. With the inkjet printing head according to the reference example, the lower electrode includes a main electrode portion constituting the piezoelectric element and an extension portion led out from the main electrode portion in a direction along a front surface of the movable film. A hydrogen barrier film and an insulating film are formed successively above the piezoelectric element and the lower electrode. A first contact hole, exposing a portion of a front surface of the upper electrode, and a second contact hole, exposing a portion of a front surface of the extension portion of the lower electrode, are formed in the hydrogen barrier film and the insulating film. A first upper wiring, having one end portion connected to the upper electrode via the first contact hole, and a first lower wiring, having one end portion connected to the lower electrode via the second contact hole, are formed above the insulating film. The first upper wiring and the first lower wiring are constituted of aluminum or other metal besides gold.

A passivation film covering the first upper wiring and the first lower wiring is formed above the insulating film. A first opening, exposing a portion of a front surface of the first upper wiring, and a second opening, exposing a portion of a front surface of the first lower wiring, are formed in the passivation film. A second upper wiring (gold lead wire), made of gold and having one end portion connected to the first upper wiring via the first opening, and a second lower wiring (gold lead wire), made of gold and having one end portion connected to the first lower wiring via the second opening, are formed above the passivation film. The second upper wiring and the second lower wiring are connected to a drive circuit (piezoelectric element driving LSI).

With the inkjet printing head according to the reference example, the first upper wiring and the second upper wiring are required as upper wirings arranged to connect the upper electrode to the drive circuit and therefore a process of forming the upper wirings is complicated. Similarly, the first lower wiring and the second lower wiring are required as lower wirings arranged to connect the lower electrode to the drive circuit and therefore a process of forming the lower wirings is complicated. Therefore, with the inkjet printing head according to the reference example, a process of manufacturing the inkjet printing head is cumbersome.

An object of the present invention is to provide a device using a piezoelectric element and a method for manufacturing the same, with which manufacturing is simple.

In order to overcome the previously unrecognized and unsolved challenges described above, a preferred embodiment of the present invention provides a first device using a piezoelectric element. The first device using the piezoelectric element includes a cavity, a movable film formation layer including a movable film disposed above the cavity and defining a top surface portion of the cavity, and a piezoelectric element formed above the movable film, and the piezoelectric element includes a lower electrode formed above the movable film, a piezoelectric film formed above the lower electrode, and an upper electrode formed above the piezoelectric film. The lower electrode includes a main electrode portion constituting the piezoelectric element and an extension portion led out from the main electrode portion in a direction along a front surface of the movable film formation layer. The first device using the piezoelectric element further includes a hydrogen barrier film, covering entireties of side surfaces of the upper electrode and the piezoelectric film, at least a portion of an upper surface of the upper electrode, and at least a portion of an upper surface of the lower electrode, an insulating film, formed above the hydrogen barrier film, an upper wiring, made of gold, formed above the insulating film, and arranged to connect the upper electrode to a drive circuit, and a lower wiring, made of gold, formed above the insulating film, and arranged to connect the lower electrode to the drive circuit. A first contact hole, exposing a portion of the upper electrode, and a second contact hole, exposing a portion of the extension portion, are formed in the hydrogen barrier film and the insulating film. The upper wiring is connected to the upper surface of the upper electrode via the first contact hole. The lower wiring is connected to the upper surface of the extension portion via the second contact hole.

With the present arrangement, the upper wiring arranged to connect the upper electrode to the drive circuit is constituted from one type of wiring. Similarly, the lower wiring arranged to connect the lower electrode to the drive circuit is also constituted from one type of wiring. Therefore, in comparison to the inkjet printing head according to the reference example, processes for forming the upper wiring and the lower wiring are made simple. Manufacture of the inkjet printing head is thus made simple in comparison to the inkjet printing head according to the reference example.

Also with the present arrangement, the upper wiring and the lower wiring are made of gold, which is high in corrosion resistance, and therefore a passivation film for protecting the wirings may be omitted. When the passivation film is omitted, the manufacture of the inkjet printing head is made simpler.

In the preferred embodiment of the present invention, the upper electrode has, in a plan view of viewing from a direction normal to a major surface of the movable film, a peripheral edge that is receded further toward an interior of the cavity than the movable film and the upper wiring has, in the plan view, one end portion connected to the upper surface of the upper electrode and another end portion led out to an outer side of a top surface portion peripheral edge of the cavity.

In the preferred embodiment of the present invention, the extension portion is led out from the main electrode portion in a direction along a front surface of the movable film formation layer and, in the plan view of viewing from the direction normal to the major surface of the movable film, extends across the top surface portion peripheral edge of the cavity to outside the cavity. The lower wiring is electrically connected to an upper surface of an outer electrode region of the extension portion that is located further outward than the top surface portion peripheral edge of the cavity.

In the preferred embodiment of the present invention, the top surface portion of the cavity is, in the plan view, a rectangle that is long in one predetermined direction. The upper electrode is, in the plan view, a rectangle that is long in the one direction and has a width shorter than a width in a short direction of the top surface portion of the cavity and a length shorter than a length in along direction of the top surface portion of the cavity, with both end edges and both side edges thereof being respectively receded further toward the interior of the cavity than both end edges and both side edges of the top surface portion of the cavity. Each of the piezoelectric film and the main electrode portion has a shape of the same pattern as the upper electrode in the plan view. The extension portion extends from a peripheral edge of the main electrode portion, across the top surface portion peripheral edge of the cavity, to outside the top surface portion peripheral edge. The upper wiring extends, in the plan view, from an upper surface of one end portion of the upper electrode to an outer side across a corresponding one end portion of the top surface portion of the cavity. The lower wiring includes, in the plan view, a base portion, disposed at an outer side of another end portion of the top surface portion of the cavity, and a lead portion, extending from the base portion and along one side portion of the top surface portion of the cavity and thereafter extending parallel to the upper wiring.

In the preferred embodiment of the present invention, the movable film formation layer is constituted of an $SiO_2$ single film.

In the preferred embodiment of the present invention, the movable film formation layer is constituted of a laminated film of an Si film formed above the substrate, an $SiO_2$ film formed above the Si film, and an SiN film formed above the $SiO_2$ film.

In the preferred embodiment of the present invention, the piezoelectric film is constituted of a PZT film.

In the preferred embodiment of the present invention, the upper electrode is constituted of a Pt single film.

In the preferred embodiment of the present invention, the upper electrode is constituted of a laminated film of an $IrO_2$ film formed above the piezoelectric film and an Ir film formed above the $IrO_2$ film.

In the preferred embodiment of the present invention, the lower electrode is constituted of a laminated film of a Ti film formed at the movable film side and a Pt film formed above the Ti film.

A second device using a piezoelectric element according to the present invention includes a cavity, a movable film formation layer including a movable film disposed above the cavity and defining a top surface portion of the cavity, and a piezoelectric element formed above the movable film, and the piezoelectric element includes a lower electrode formed above the movable film, a piezoelectric film formed above the lower electrode, and an upper electrode formed above the piezoelectric film. The lower electrode includes a main electrode portion constituting the piezoelectric element and an extension portion led out from the main electrode portion in a direction along a front surface of the movable film formation layer. The second device using the piezoelectric element further includes a hydrogen barrier film, covering entireties of side surfaces of the upper electrode and the piezoelectric film, at least a portion of an upper surface of the upper electrode, and at least a portion of an upper surface of the lower electrode, an upper wiring, made of gold, formed above the hydrogen barrier film, and arranged to connect the upper electrode to a drive circuit, and a lower wiring, made of gold, formed above the hydrogen barrier film, and arranged to connect the lower electrode to the drive circuit. A first contact hole, exposing a portion of the upper electrode, and a second contact hole, exposing a portion of the extension portion of the lower electrode, are formed in the hydrogen barrier film. The upper wiring is connected to the upper surface of the upper electrode via the first contact hole. The lower wiring is connected to the upper surface of the extension portion of the lower electrode via the second contact hole.

With the present arrangement, the upper wiring arranged to connect the upper electrode to the drive circuit is constituted from one type of wiring. Similarly, the lower wiring arranged to connect the lower electrode to the drive circuit is also constituted from one type of wiring. Therefore, in comparison to the inkjet printing head according to the reference example, the processes for forming the upper wiring and the lower wiring are made simple. The manufacture of the inkjet printing head is thus made simple in comparison to the inkjet printing head according to the reference example.

Also with the present arrangement, an insulating film does not have to be provided. The manufacture of the inkjet printing head is thus made simpler. Also with the present arrangement, the upper wiring and the lower wiring are made of gold, which is high in corrosion resistance, and therefore a passivation film for protecting the wirings may be omitted. When the passivation film is omitted, the manufacture of the inkjet printing head is made simpler.

In the preferred embodiment of the present invention, the top surface portion of the cavity is, in a plan view of viewing from a direction normal to a major surface of the movable film, a rectangle that is long in one predetermined direction. The piezoelectric element is, in the plan view, a rectangle that is long in the one direction and has a width shorter than a width in a short direction of the top surface portion of the cavity and a length shorter than a length in along direction of the top surface portion of the cavity, with both end edges and both side edges thereof being respectively receded further toward the interior of the cavity than both end edges and both side edges of the top surface portion of the cavity. The piezoelectric film includes an active portion constituting the piezoelectric element and an inactive portion extending from one end of the active portion to an outer side of a corresponding one end of the top surface portion of the cavity. The upper electrode includes a main electrode portion formed above the active portion and an extension portion formed above the inactive portion. The upper wiring has, in the plan view, one end portion connected to the upper surface of the upper electrode and another end portion extending across one end of the upper electrode at the extension portion side to an opposite side from the main electrode portion of the upper electrode. In the plan view, the lower electrode is not present below the upper wiring outside the one end of the top surface portion of the cavity. With the present arrangement, insulation between the upper wiring and the lower electrode can be maintained even if an insulating film is not provided between the hydrogen barrier film and the upper wiring.

In the preferred embodiment of the present invention, the lower wiring includes, in the plan view, a base portion, disposed at an outer side of another end portion of the top surface portion of the cavity, and a lead portion, extending from the base portion and along one side portion of the top surface portion of the cavity and thereafter extending parallel to the upper wiring.

In the preferred embodiment of the present invention, the movable film formation layer is constituted of an $SiO_2$ single film.

In the preferred embodiment of the present invention, the movable film formation layer is constituted of a laminated film of an Si film formed above the substrate, an $SiO_2$ film formed above the Si film, and an SiN film formed above the $SiO_2$ film.

In the preferred embodiment of the present invention, the piezoelectric film is constituted of a PZT film.

In the preferred embodiment of the present invention, the upper electrode is constituted of a Pt single film.

In the preferred embodiment of the present invention, the upper electrode is constituted of a laminated film of an $IrO_2$ film formed above the piezoelectric film and an Ir film formed above the $IrO_2$ film.

In the preferred embodiment of the present invention, the lower electrode is constituted of a laminated film of a Ti film formed at the movable film side and a Pt film formed above the Ti film.

A method for manufacturing the first device using the piezoelectric element according to the present invention includes a step of forming a movable film formation layer, including a movable film formation region, above a substrate, a step of forming a lower electrode film above the movable film formation layer and thereafter patterning the lower electrode film to form a lower electrode, a step of forming a piezoelectric material film and an upper electrode film successively above the movable film formation layer and thereafter patterning the upper electrode film and the piezoelectric material film successively to form an upper electrode and a piezoelectric film to thereby form a piezoelectric element that includes the lower electrode, the upper electrode, and the piezoelectric film sandwiched thereby, a step of successively forming, above the movable film formation layer, a hydrogen barrier film and an insulating film covering the piezoelectric element and the lower electrode, a step of forming, in the hydrogen barrier film and the insulating film, a first contact hole exposing a portion of the upper electrode and a second contact hole exposing a portion of the lower electrode, a step of forming a wiring film, made of gold, above the insulating film and thereafter patterning the wiring film to form an upper wiring, made of gold, connected to the upper electrode via the first contact hole, and arranged to connect the upper electrode to a drive circuit, and a lower wiring, made of gold, connected to the lower electrode via the second contact hole, and arranged to connect the lower electrode to the drive circuit, and a step of etching the substrate from below to form a cavity facing the movable film formation region.

With the method for manufacturing the first device using the piezoelectric element, the processes for forming the upper wiring and the lower wiring are made simple in comparison to the inkjet printing head according to the reference example. The manufacture of the inkjet printing head is thus made simple in comparison to the inkjet printing head according to the reference example.

A method for manufacturing the second device using the piezoelectric element according to the present invention includes a step of forming a movable film formation layer, including a movable film formation region, above a substrate, a step of forming a lower electrode film above the movable film formation layer and thereafter patterning the lower electrode film to form a lower electrode, a step of forming a piezoelectric material film and an upper electrode film successively above the movable film formation layer and thereafter patterning the upper electrode film and the piezoelectric material film successively to form an upper electrode and a piezoelectric film to thereby form a piezoelectric element that includes the lower electrode, the upper electrode, and the piezoelectric film sandwiched thereby, a step of forming, above the movable film formation layer, a hydrogen barrier film covering the piezoelectric element and the lower electrode, a step of forming, in the hydrogen barrier film, a first contact hole exposing a portion of the upper electrode and a second contact hole exposing a portion of the lower electrode, a step of forming a wiring film, made of gold, above the hydrogen barrier film and thereafter patterning the wiring film to form an upper wiring, made of gold, connected to the upper electrode via the first contact hole, and arranged to connect the upper electrode to a drive circuit, and a lower wiring, made of gold, connected to the lower electrode via the second contact hole, and arranged to connect the lower electrode to the drive circuit, and a step of etching the substrate from below to form a cavity facing the movable film formation region.

With the method for manufacturing the second device using the piezoelectric element, the processes for forming the upper wiring and the lower wiring are made simple in comparison to the inkjet printing head according to the reference example. The manufacture of the inkjet printing head is thus made simple in comparison to the inkjet printing head according to the reference example.

The above and other elements, features, steps, characteristics and advantages of the present invention will become more apparent from the following detailed description of the preferred embodiments with reference to the attached drawings.

DETAILED DESCRIPTION OF THE PREFERRED EMBODIMENTS

A preferred embodiment of the present invention shall now be described in detail with reference to the attached drawings.

Figure 1A:
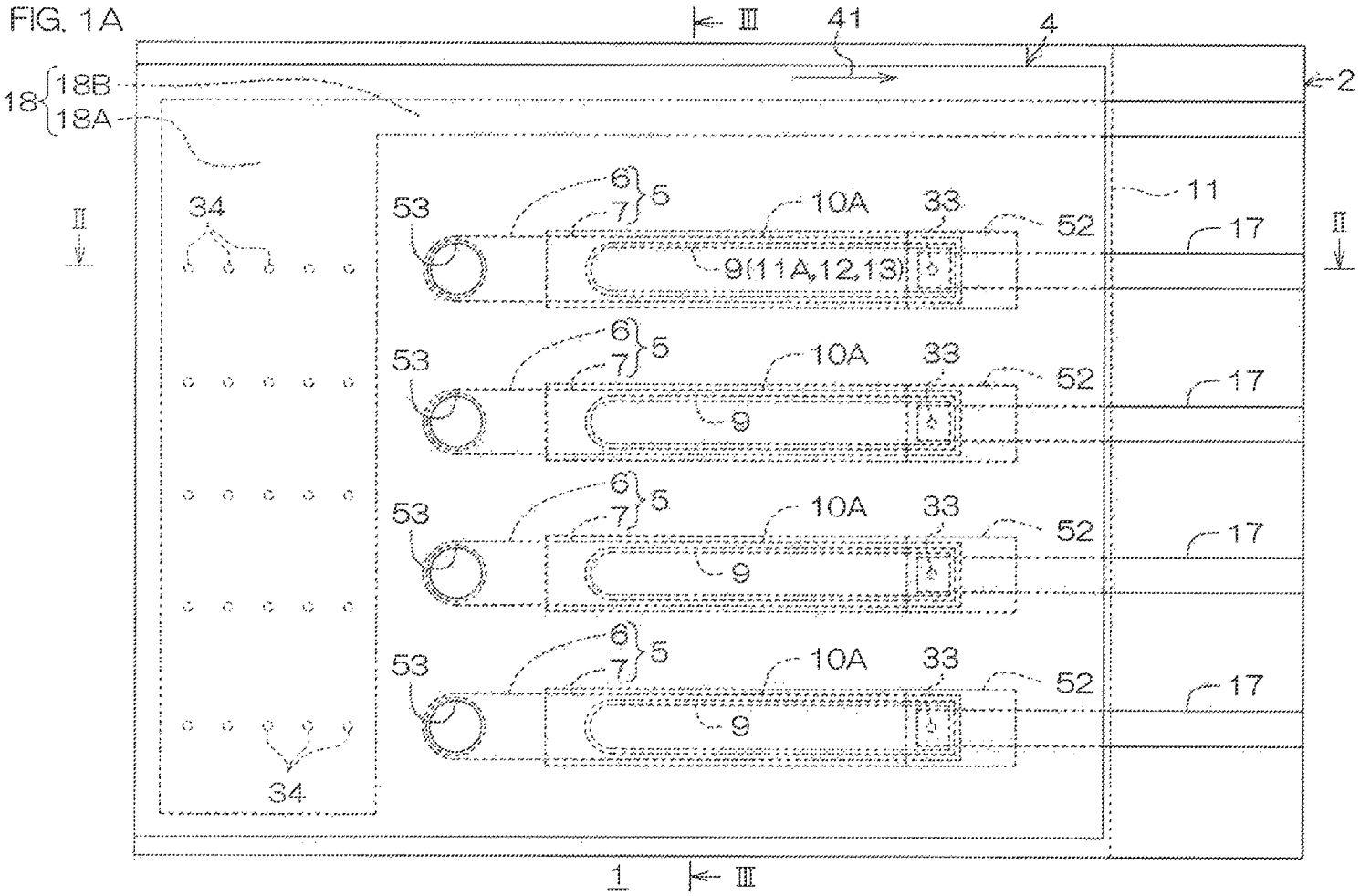
FIG. 1A is an illustrative plan view for describing the arrangement of a main portion of an inkjet printing head according to a first preferred embodiment of the present invention.
Figure 1B:
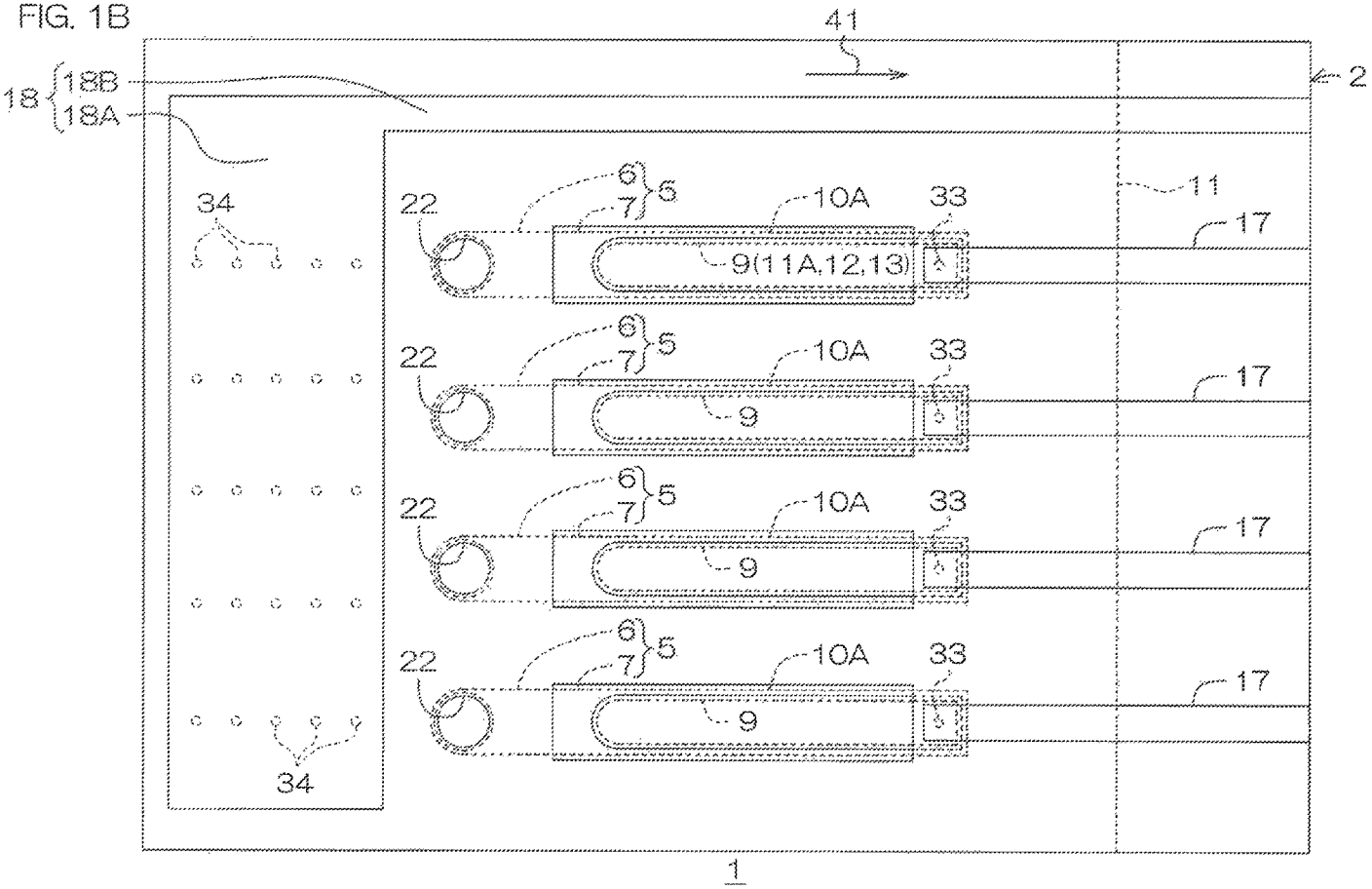
FIG. 1B is an illustrative plan view of the main portion of the inkjet printing head of FIG. 1A and is a plan view with a protective substrate omitted.
Figure 2:
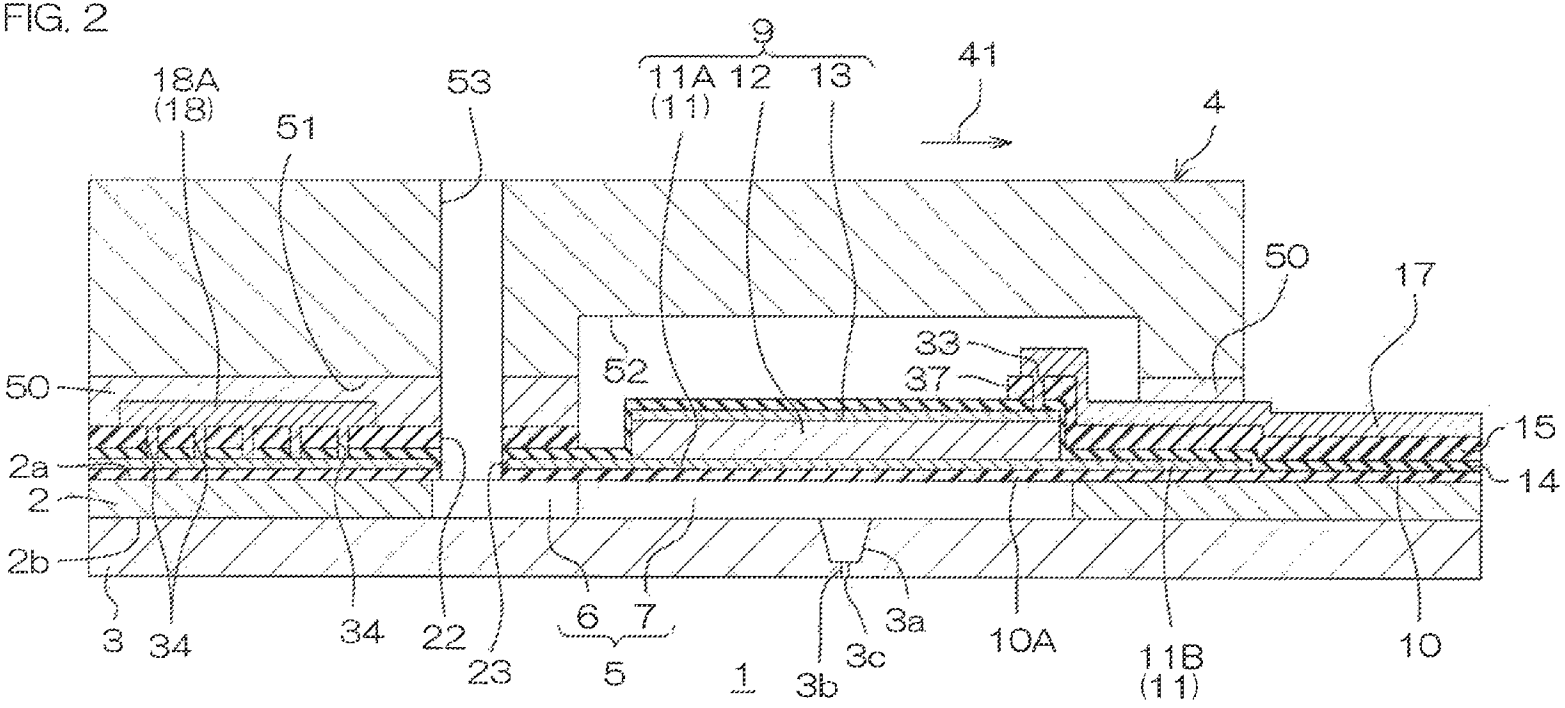
FIG. 2 is an illustrative sectional view taken along line II-II in FIG. 1A.
Figure 3:
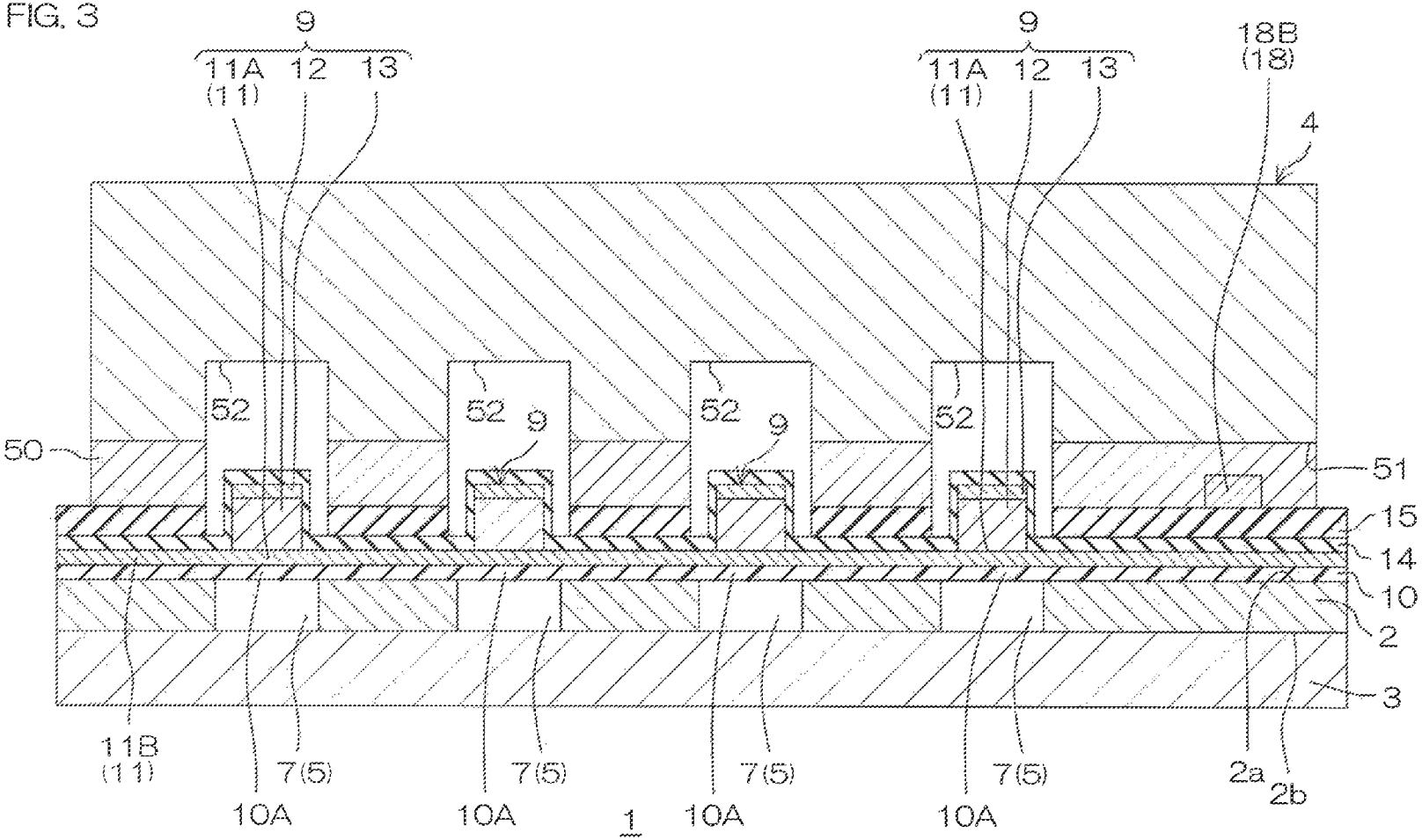
FIG. 3 is an illustrative enlarged sectional view of a portion of a section taken along line III-III in FIG. 1A.
Figure 4:
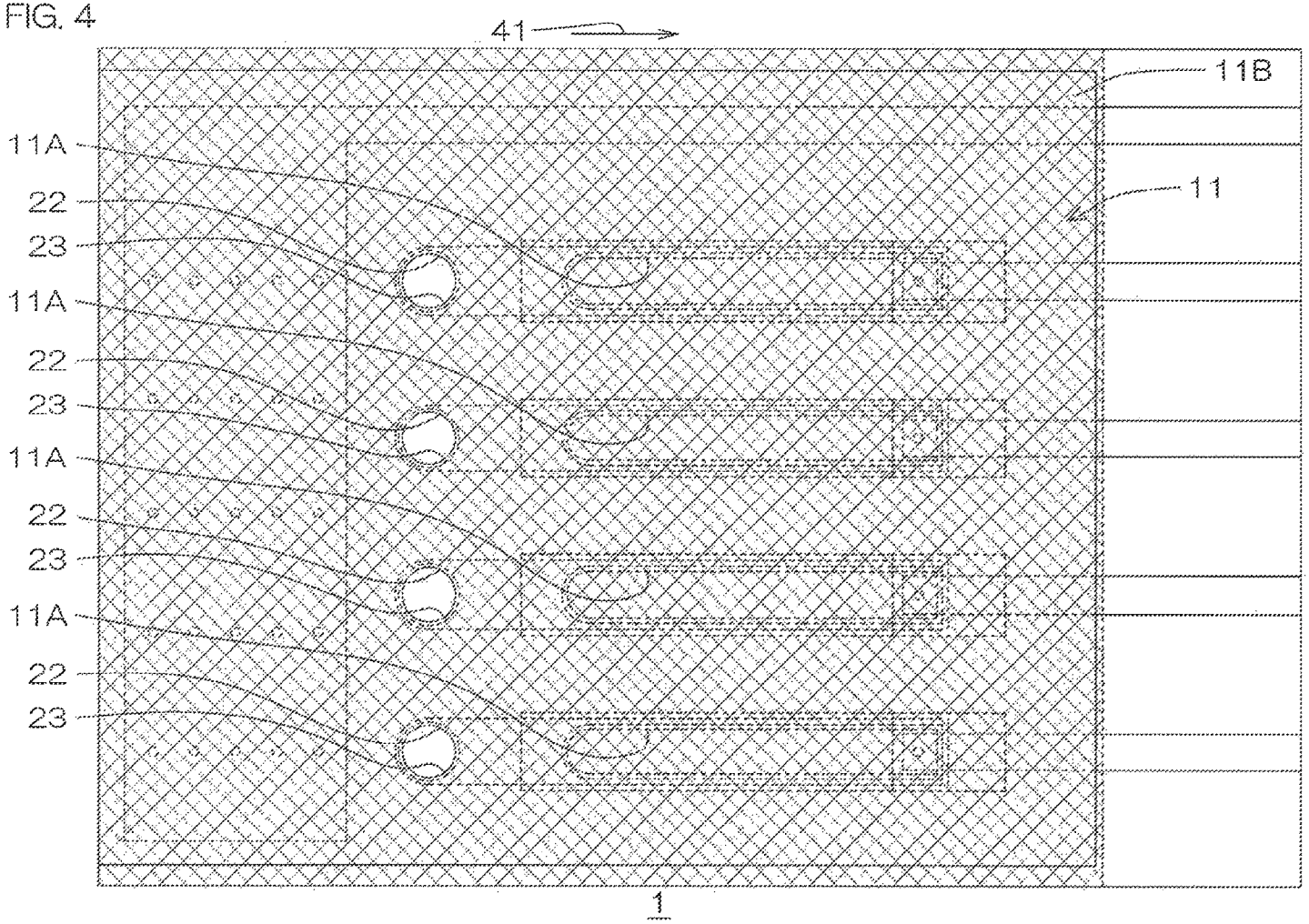
FIG. 4 is an illustrative plan view of a pattern example of a lower electrode of the inkjet printing head.

FIG. 1A is an illustrative plan view for describing the arrangement of a main portion of an inkjet printing head according to a first preferred embodiment of the present invention. FIG. 1B is an illustrative plan view of the main portion of the inkjet printing head 1 and is a plan view with a protective substrate omitted. FIG. 2 is an illustrative sectional view taken along line II-II in FIG. 1A. FIG. 3 is an illustrative enlarged sectional view of a portion of a section taken along line III-III in FIG. 1A. FIG. 4 is an illustrative plan view of a pattern example of a lower electrode of the inkjet printing head.

The arrangement of an inkjet printing head 1 shall now be described in outline with reference to FIG. 2.

The inkjet printing head 1 includes an actuator substrate 2, a nozzle substrate 3, and a protective substrate 4. A movable film formation layer 10 is laminated on a front surface of the actuator substrate 2. In the actuator substrate 2, ink flow passages (ink reservoirs) 5 are formed. In the present preferred embodiment, the ink flow passages 5 are formed to penetrate through the actuator substrate 2. Each ink flow passage 5 is formed to be elongate along an ink flow direction 41, which is indicated by an arrow in FIG. 2. Each ink flow passage 5 is constituted of an ink inflow portion 6 at an upstream side end portion (left end portion in FIG. 2) in the ink flow direction 41 and a pressure chamber 7 in communication with the ink inflow portion 6. In FIG. 2, a boundary between the ink inflow portion 6 and the pressure chamber 7 is indicated by an alternate long and two short dashes line.

The nozzle substrate 3 is constituted, for example, of a silicon substrate. The nozzle substrate 3 is adhered to a rear surface 2*b* of the actuator substrate 2. The nozzle substrate 3, together with the actuator substrate 2 and the movable film formation layer 10, defines the ink flow passages 5. More specifically, the nozzle substrate 3 defines bottom surface portions of the ink flow passages 5. The nozzle substrate 3 has recess portions 3*a* each facing a pressure chamber 7 and an ink discharge passage 3*b* is formed in a bottom surface of each recess portion 3*a*. Each ink discharge passage 3*b* penetrates through the nozzle substrate 3 and has a discharge port 3*c* at an opposite side from the pressure chamber 7. Therefore, when a volume change occurs in a pressure chamber 7, the ink retained in the pressure chamber 7 passes through the ink discharge passage 3*b* and is discharged from the discharge port 3*c*.

Each portion of the movable film formation layer 10 that is a top roof portion of a pressure chamber 7 constitutes a movable film 10A. The movable film 10A (movable film formation layer 10) is constituted, for example, of a silicon oxide ($SiO_2$) film formed above the actuator substrate 2. The movable film 10A (movable film formation layer 10) may be constituted of a laminated film, for example, of a silicon (Si) film formed above the actuator substrate 2, a silicon oxide ($SiO_2$) film formed above the silicon film, and a silicon nitride (SiN) film formed above the silicon oxide film. In the present specification, the movable film 10A refers to a top roof portion of the movable film formation layer 10 that defines the top surface portion of the pressure chamber 7. Therefore, portions of the movable film formation layer 10 besides the top roof portions of the pressure chambers 7 do not constitute the movable film 10A.

Each movable film 10A has a thickness of, for example, 0.4 μm to 2 μm. If the movable film 10A is constituted of a silicon oxide film, the thickness of the silicon oxide film may be approximately 1.2 μm. If the movable film 10A is constituted of a laminated film of a silicon film, a silicon oxide film, and a silicon nitride film, the thickness of each of the silicon film, the silicon oxide film, and the silicon nitride film may be approximately 0.4 μm.

Each pressure chamber 7 is defined by a movable film 10A, the actuator substrate 2, and the nozzle substrate 3 and is formed to a substantially rectangular parallelepiped shape in the present preferred embodiment. The pressure chamber 7 may, for example, have a length of approximately 800 μm and a width of approximately 55 μm. Each ink inflow portion 6 is in communication with one end portion in a long direction of a pressure chamber 7.

A piezoelectric element 9 is disposed on a front surface of each movable film 10A. Each piezoelectric element 9 includes a lower electrode 11 formed above the movable film formation layer 10, a piezoelectric film 12 formed above the lower electrode 11, and an upper electrode 13 formed above the piezoelectric film 12. In other words, the piezoelectric element 9 is arranged by sandwiching the piezoelectric film 12 from above and below by the upper electrode 13 and the lower electrode 11.

The upper electrode 13 may be a single film of platinum (Pt) or may have a laminated structure, for example, in which a conductive oxide film (for example, an $IrO_2$ (iridium oxide) film) and a metal film (for example, an Ir (iridium) film) are laminated. The upper electrode 13 may have a thickness, for example, of approximately 0.2 μm.

As each piezoelectric film 12, for example, a PZT ($PbZr_xTi_{1-x}O_3$: lead zirconate titanate) film formed by a sol-gel method or a sputtering method may be applied. Such a piezoelectric film 12 is constituted of a sintered body of a metal oxide crystal. The piezoelectric film 12 is formed to be of the same shape as the upper electrode 13 in plan view. The piezoelectric film 12 has a thickness of approximately 1 μm. The overall thickness of each movable film 10A is preferably approximately the same as the thickness of the piezoelectric film 12 or approximately ⅔ the thickness of the piezoelectric film 12.

The lower electrode 11 has, for example, a two-layer structure with a Ti (titanium) film and a Pt (platinum) film being laminated successively from the movable film formation layer 10 side. Besides this, the lower electrode 11 may be formed of a single film that is an Au (gold) film, a Cr (chromium) layer, or an Ni (nickel) layer, etc. The lower electrode 11 has main electrode portions 11A, in contact with lower surfaces of the piezoelectric films 12, and an extension portion 11B extending to a region outside the piezoelectric films 12. The lower electrode 11 may have a thickness, for example, of approximately 0.2 μm.

A hydrogen barrier film 14 is formed above the extension portion 11B of the lower electrode 11 and above the piezoelectric elements 9. The hydrogen barrier film 14 is constituted, for example, of $Al_2O_3$ (alumina). The hydrogen barrier film 14 has a thickness of approximately 50 nm to 100 nm. The hydrogen barrier film 14 is provided to prevent degradation of characteristics of the piezoelectric film 12 due to hydrogen reduction.

An insulating film 15 is laminated on the hydrogen barrier film 14. The insulating film 15 is constituted, for example, of $SiO_2$ or low-hydrogen SiN, etc. The insulating film 15 has a thickness of approximately 500 nm. Upper wirings 17, made of gold (Au) and arranged to connect the upper electrodes 13 to an unillustrated drive circuit (piezoelectric element driving LSI), and a lower wiring 18, made of gold and arranged to connect the lower electrode 11 to the drive circuit, are formed above the insulating film 15. The wirings 17 and 18 have a thickness, for example, of approximately 1000 nm (1 μm).

One end portion of each upper wiring 17 is disposed above one end portion (downstream side end portion in the ink flow direction 41) of an upper electrode 13. A contact hole 33, penetrating continuously through the hydrogen barrier film 14 and the insulating film 15, is formed between the upper wiring 17 and the upper electrode 13. The one end portion of the upper wiring 17 enters into the contact hole 33 and is connected to the upper electrode 13 inside the contact hole 33. From above the upper electrode 13, the upper wiring 17 crosses an outer edge of the pressure chamber 7 and extends outside the pressure chamber 7.

The lower wiring 18 includes a base portion 18A disposed above the extension portion 11B of the lower electrode 11 at an opposite side from the pressure chambers 7 with respect to the ink inflow portions 6 of the ink flow passages 5. A plurality of contact holes 34, penetrating continuously through the hydrogen barrier film 14 and the insulating film 15, are formed between the base portion 18A of the lower wiring 18 and the extension portion 11B of the lower electrode 11. The base portion 18A of the lower wiring 18 enters into the contact holes 34 and is connected to the extension portion 11B of the lower electrode 11 inside the contact holes 34.

Ink supply penetrating holes 22, penetrating through the insulating film 15, the hydrogen barrier film 14, the lower electrode 11, and the movable film formation layer 10 are formed at positions corresponding to end portions of the ink flow passages 5 at the ink inflow portion 6 sides. Penetrating holes 23, each including an ink supply penetrating hole 22 and being larger than the ink supply penetrating hole 22, are formed in the lower electrode 11. The hydrogen barrier film 14 enters into gaps between the penetrating holes 23 in the lower electrode 11 and the ink supply penetrating holes 22. The ink supply penetrating holes 22 are in communication with the ink inflow portions 6.

The protective substrate 4 is constituted, for example, of a silicon substrate. The protective substrate 4 is disposed above the actuator substrate 2 so as to cover the piezoelectric elements 9. The protective substrate 4 is bonded to the actuator substrate 2 via an adhesive 50. The protective substrate 4 has housing recesses 52 in a facing surface 51 that faces a front surface 2*a* of the actuator substrate 2. The piezoelectric elements 9 are housed inside the housing recesses 52. Further, the protective substrate 4 has formed therein ink supply passages 53 that are in communication with the ink supply penetrating holes 22. The ink supply passages 53 penetrate through the protective substrate 4. An ink tank (not shown) storing ink is disposed above the protective substrate 4.

Each piezoelectric element 9 is formed at a position facing a pressure chamber 7 across a movable film 10A. That is, the piezoelectric element 9 is formed to contact a front surface of the movable film 10A at the opposite side from the pressure chamber 7. Each pressure chamber 7 is filled with ink by the ink being supplied from the ink tank to the pressure chamber 7 through an ink supply passage 53, an ink supply penetrating hole 22, and an ink inflow portion 6. The movable film 10A defines a top surface portion of the pressure chamber 7 and faces the pressure chamber 7. The movable film 10A is supported by portions of the actuator substrate 2 at a periphery of the pressure chamber 7 and has flexibility enabling deformation in a direction facing the pressure chamber 7 (in other words, in the thickness direction of the movable film 10A).

The upper wirings 17 and the lower wiring 18 are connected to the drive circuit. When a drive voltage is applied from the drive circuit to a piezoelectric element 9, the piezoelectric film 12 deforms due to an inverse piezoelectric effect. The movable film 10A is thereby made to deform together with the piezoelectric element 9 to bring about a volume change of the pressure chamber 7 and the ink inside the pressure chamber 7 is pressurized. The pressurized ink passes through the ink discharge passage 3*b* and is discharged as microdroplets from the discharge port 3*c*.

The arrangement of the inkjet printing head 1 shall now be described in more detail with reference to FIG. 1A to FIG. 4.

A plurality of the ink flow passages 5 (pressure chambers 7) are formed as stripes extending parallel to each other in the actuator substrate 2. The piezoelectric element 9 is disposed respectively in each of the plurality of ink flow passages 5. The ink supply penetrating holes 22 are provided respectively for each of the plurality of ink flow passages 5. The housing recesses 52 and the ink supply passages 53 in the protective substrate 4 are provided respectively for each of the plurality of ink flow passages 5.

The plurality of ink flow passages 5 are formed at equal intervals that are minute intervals (for example, of approximately 30 μm to 350 μm) in a width direction thereof. Each ink flow passage 5 is elongate along the ink flow direction 41. Each ink flow passage 5 is constituted of an ink inflow portion 6 in communication with an ink supply penetrating hole 22 and the pressure chamber 7 in communication with the ink inflow portion 6. In plan view, the pressure chamber 7 has an oblong shape that is elongate along the ink flow direction 41. That is, the top surface portion of the pressure chamber 7 has two side edges along the ink flow direction 41 and two end edges along a direction orthogonal to the ink flow direction 41. In plan view, the ink inflow portion 6 has substantially the same width as the pressure chamber 7. An inner surface of an end portion of the ink inflow portion 6 at an opposite side from the pressure chamber 7 is formed to a semicircle in plan view. The ink supply penetrating hole 22 is circular in plan view (see especially FIG. 1B).

Each piezoelectric element 9 has, in plan view, a rectangular shape that is long in a long direction of a pressure chamber 7 (movable film 10A). A length in a long direction of the piezoelectric element 9 is shorter than a length in the long direction of the pressure chamber 7 (movable film 10A). As shown in FIG. 1B, respective end edges along a short direction of the piezoelectric element 9 are disposed at inner sides at predetermined intervals respectively from respective corresponding end edges of the movable film 10A. Also, a width in the short direction of the piezoelectric element 9 is narrower than a width in a short direction of the movable film 10A. Respective side edges along the long direction of the piezoelectric element 9 are disposed at inner sides at predetermined intervals from respective corresponding side edges of the movable film 10A.

The lower electrode 11 is formed on substantially an entirety of a front surface of a main portion of the movable film formation layer 10 (see especially FIG. 4). However, the lower electrode 11 is not formed in a region separated by not less than a predetermined distance toward downstream sides from downstream side ends in the ink flow direction of the pressure chambers 7. The lower electrode 11 is a common electrode used in common for the plurality of piezoelectric elements 9. The lower electrode 11 includes the main electrode portions 11A of rectangular shape in plan view that constitute the piezoelectric elements 9 and the extension portion 11B led out from the main electrode portions 11A in directions along the front surface of the movable film formation layer 10 to extend outside the peripheral edges of the top surface portions of the pressure chambers 7.

A length in a long direction of each main electrode portion 11A is shorter than the length in the long direction of each movable film 10A. Respective end edges of the main electrode portion 11A are disposed at inner sides at predetermined intervals respectively from the respective corresponding end edges of the movable film 10A. Also, a width in a short direction of the main electrode portion 11A is narrower than the width of the movable film 10A in the short direction. Respective side edges of the main electrode portion 10A are disposed at inner sides at predetermined intervals from the respective corresponding side edges of the movable film 10A. The extension portion 11B is a region of the entire region of the lower electrode 11 excluding the main electrode portions 11A.

In plan view, the upper electrodes 13 are formed to rectangular shapes of the same pattern as the main electrode portions 11A of the lower electrode 11. That is, a length in a long direction of each upper electrode 13 is shorter than the length in the long direction of each movable film 10A. Respective end edges of the upper electrode 13 are disposed at inner sides at predetermined intervals respectively from the respective corresponding end edges of the movable film 10A. Also, a width in a short direction of the upper electrode 13 is narrower than the width in the short direction of the movable film 10A. Respective side edges of the upper electrode 13 are disposed at inner sides at predetermined intervals from the respective corresponding side edges of the movable film 10A.

In plan view, the piezoelectric films 12 are formed to rectangular shapes of the same pattern as the upper electrodes 13. That is, a length in a long direction of each piezoelectric film 12 is shorter than the length in the long direction of each movable film 10A. Respective end edges of the piezoelectric film 12 are disposed at inner sides at predetermined intervals respectively from the respective corresponding end edges of the movable film 10A. Also, a width in a short direction of the piezoelectric film 12 is narrower than the width in the short direction of the movable film 10A. Respective side edges of the piezoelectric film 12 are disposed at inner sides at predetermined intervals from the respective corresponding side edges of the movable film 10A. A lower surface of the piezoelectric film. 12 contacts an upper surface of the main electrode portion 11A of the lower electrode 11 and an upper surface of the piezoelectric film 12 contacts a lower surface of an upper electrode 13.

Each upper wiring 17 extends along the ink flow direction 41 from an upper surface of one end portion of the corresponding piezoelectric element 9. In plan view, the upper wiring 17 extends from the upper surface of the one end portion of the piezoelectric element 9 (upper electrode 13) to an outer side across the corresponding one end portion of the top surface portion of the corresponding pressure chamber 7. Specifically, the upper wiring 17 extends from the upper surface of the one end portion of the piezoelectric element 9, along an end surface of the piezoelectric element 9 continuous to the upper surface, and extends further along front surfaces of the extension portion 11B of the lower electrode 11 and the hydrogen barrier film 14. A tip portion of the upper wiring 17 extends downstream in the ink flow direction 41 of the protective substrate 4. A connection terminal portion (not shown) is formed at the tip portion of the upper wiring 17.

In plan view, the lower wiring 18 has the rectangular base portion 18A that is long in a direction orthogonal to the ink flow direction 41 and a lead portion 18B extending along the ink flow direction 41 from one end portion of the base portion 18A. The lead portion 18B extends from the one end portion (one side portion) of the base portion 18A, along one side portion of the top surface portion of each pressure chamber 7, and thereafter extends parallel to the upper wirings 17. A tip portion of the lead portion 18B extends further downstream in the ink flow direction 41 than the downstream side end of the protective substrate 4. A connection terminal portion (not shown) is formed at the tip portion of the lead portion 18B.

Figure 6:
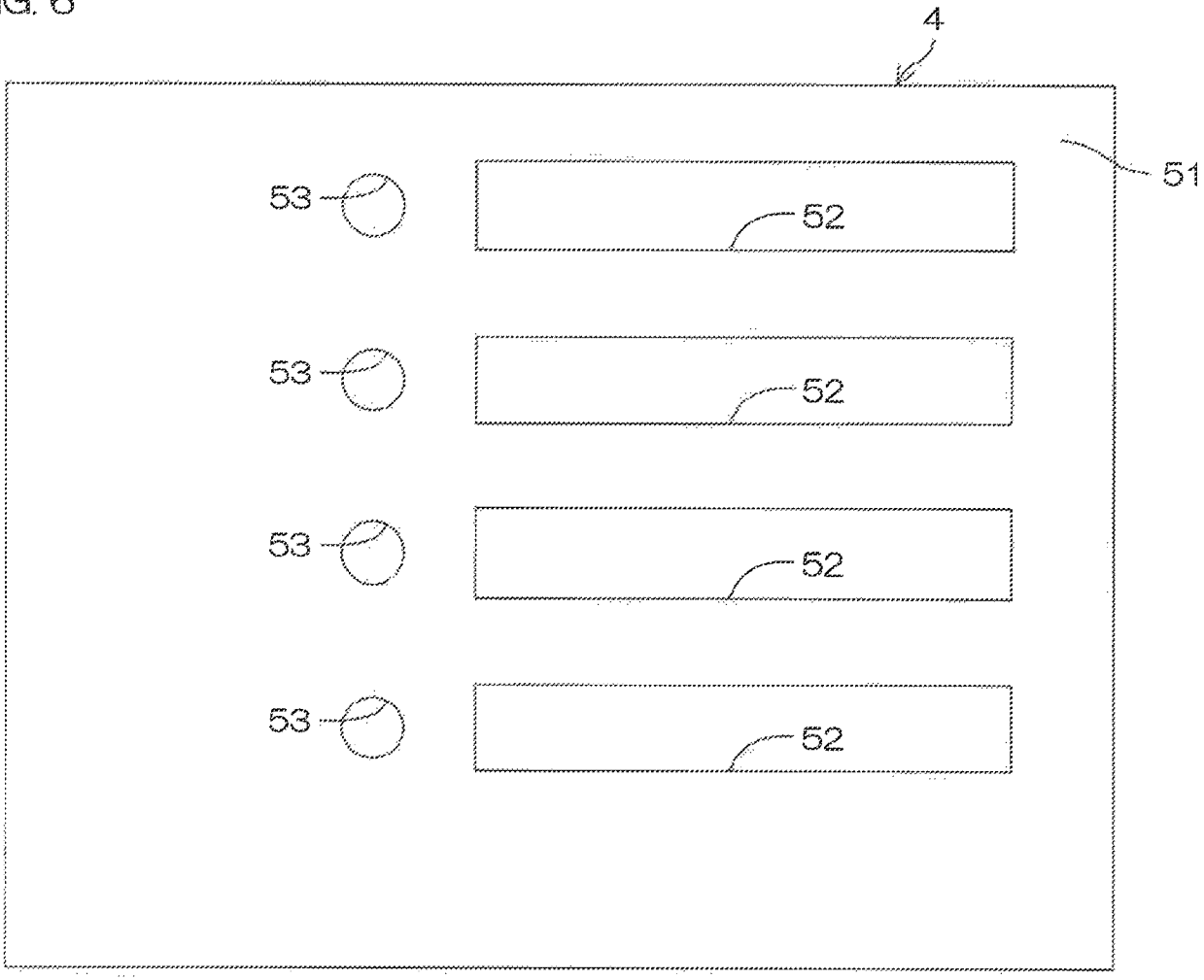
FIG. 6 is a bottom view of a main portion of the protective substrate as viewed from an actuator substrate side of the inkjet printing head.

FIG. 6 is a bottom view of a main portion of the protective substrate as viewed from the actuator substrate side of the inkjet printing head.

As shown in FIG. 1A, FIG. 3, and FIG. 6, in the facing surface 51 of the protective substrate 4, the plurality of housing recesses 52 are formed in parallel at intervals in a direction orthogonal to the ink flow direction 41. In plan view, the plurality of housing recesses 52 are disposed at positions facing the plurality of pressure chambers 7. With respect to the respective housing recesses 52, the ink supply passages 53 are disposed at upstream sides in the ink flow direction 41. In plan view, each housing recess 52 is formed to a rectangular shape slightly larger than the pattern of the upper electrode 13 of the corresponding piezoelectric element 9. The corresponding piezoelectric element 9 is housed in each housing recess 52.

In plan view, the ink supply passages 53 of the protective substrate 4 have circular shapes of the same pattern as the ink supply penetrating holes 22 at the actuator substrate 2 side. In plan view, the ink supply passages 53 are matched with the ink supply penetrating holes 22.

Figure 5:
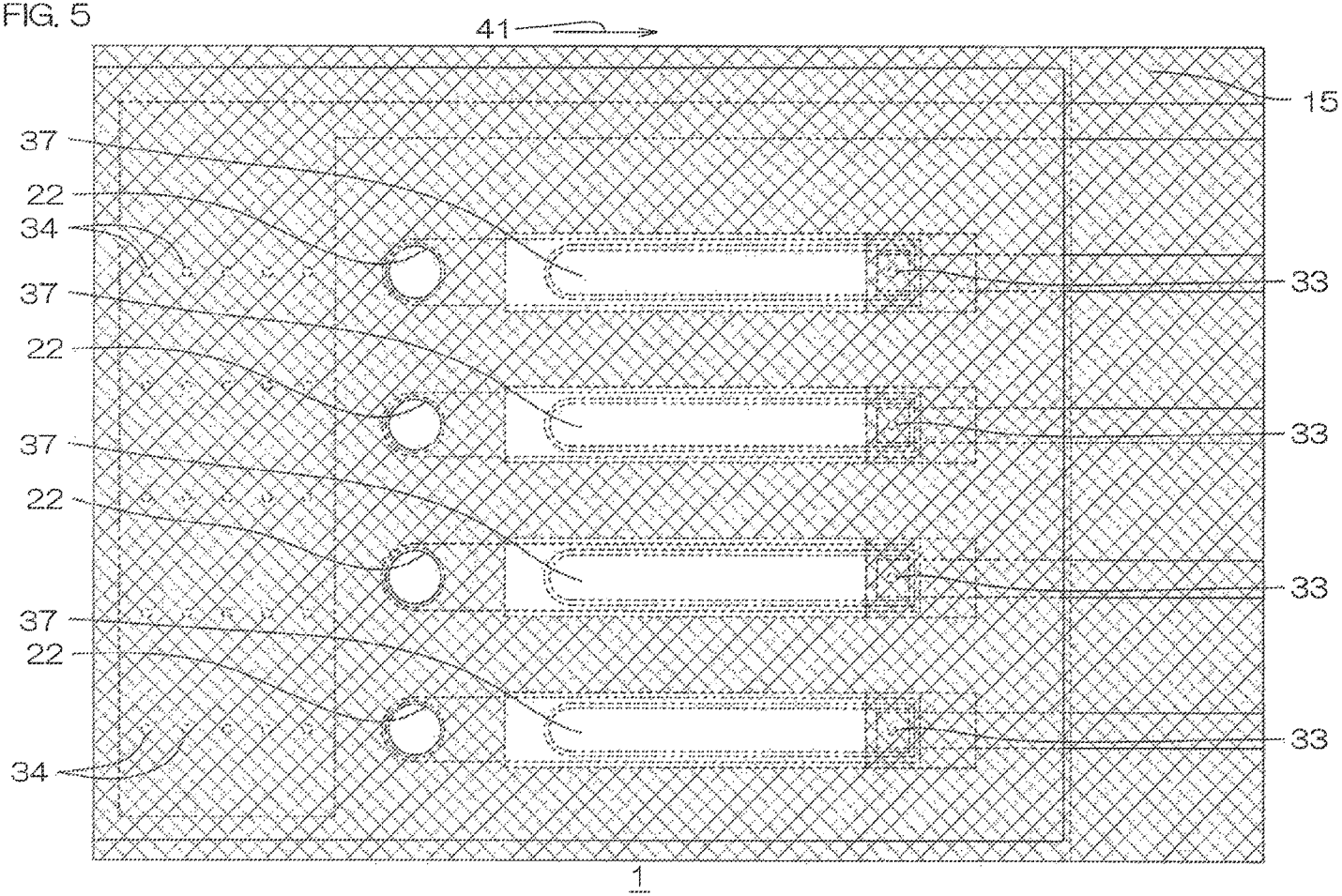
FIG. 5 is an illustrative plan view of a pattern example of an insulating film of the inkjet printing head.

FIG. 5 is an illustrative plan view of a pattern example of the insulating film of the inkjet printing head.

In the present preferred embodiment, above the actuator substrate 2, the insulating film 15 is formed on substantially an entirety of a region of the protective substrate 4 outside the housing recesses 52 in plan view. However, in this region, the ink supply penetrating holes 22 and the contact holes 34 are formed in the insulating film 15. In the regions of the protective substrate 4 inside the housing recesses 52, the insulating film 15 is formed just in one end portions (upper wiring regions) in which the upper wirings 17 are present. In other words, in the insulating film 15, openings 37 are formed in regions, within the inner side regions of the housing recesses 52 in plan view, that exclude the upper wiring regions. The contact holes 33 are further formed in the insulating film 15.

In the present preferred embodiment, in a region at the inner side of the peripheral edge of each pressure chamber 7 in plan view, the insulating film 15 is formed just in the upper wiring region in which an upper wiring 17 is present. Therefore, most of the side surface and the upper surface of each piezoelectric element 9 are not covered by the insulating film 15. Displacement of each movable film 10A can thereby be increased in comparison to a case where entireties of the side surface and the upper surface of the piezoelectric element 9 are covered by an insulating film. Also with the present preferred embodiment, a passivation film that covers the wirings 17 and 18 is not formed above the insulating film 15. The displacement of each movable film 10A can thereby be increased in comparison to a case where at least a portion of the side surface and the upper surface of the piezoelectric element 9 is covered by a passivation film. In the present preferred embodiment, the wirings 17 and 18 are not covered by a passivation film because of being made of gold and being high in corrosion resistance.

FIG. 7A to FIG. 7J are sectional views of an example of a manufacturing process of the inkjet printing head 1 and show a section corresponding to FIG. 2.

Figure 7A:
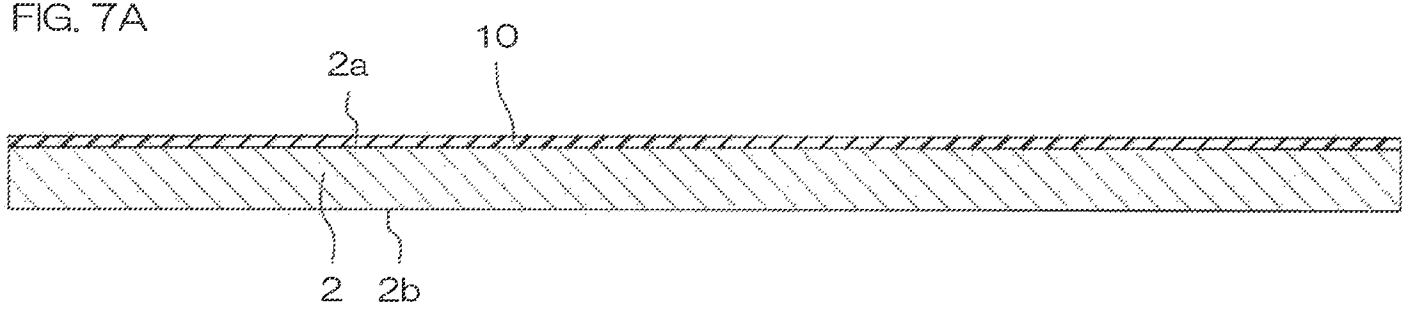
FIG. 7A is a sectional view of an example of a manufacturing process of the inkjet printing head.

First, as shown in FIG. 7A, the movable film formation layer 10 is formed on the front surface 2*a* of the actuator substrate 2. However, as the actuator substrate 2, that which is thicker than the thickness of the actuator substrate 2 at the final stage is used. Specifically, a silicon oxide film (for example, of 1.2 μm thickness) is formed on the front surface of the actuator substrate 2. If the movable film formation layer 10 is constituted of a laminated film of a silicon film, a silicon oxide film, and a silicon nitride film, the silicon film (for example, of 0.4 μm thickness) is formed on the front surface of the actuator substrate 2, the silicon oxide film (for example, of 0.4 μm thickness) is formed above the silicon film, and the silicon nitride film (for example, of 0.4 μm thickness) is formed above the silicon oxide film.

A base oxide film, for example, of $Al_2O_3$, MgO, or $ZrO_2$, etc., may be formed on the front surface of the movable film formation layer 10. Such base oxide films prevent metal atoms from escaping from the piezoelectric film 12 to be formed later. When metal electrons escape, the piezoelectric film 12 may degrade in piezoelectric characteristics. Also, when metal atoms that have escaped become mixed in the silicon layer constituting each movable film 10A, the movable film 10A may degrade in durability.

Figure 7B:
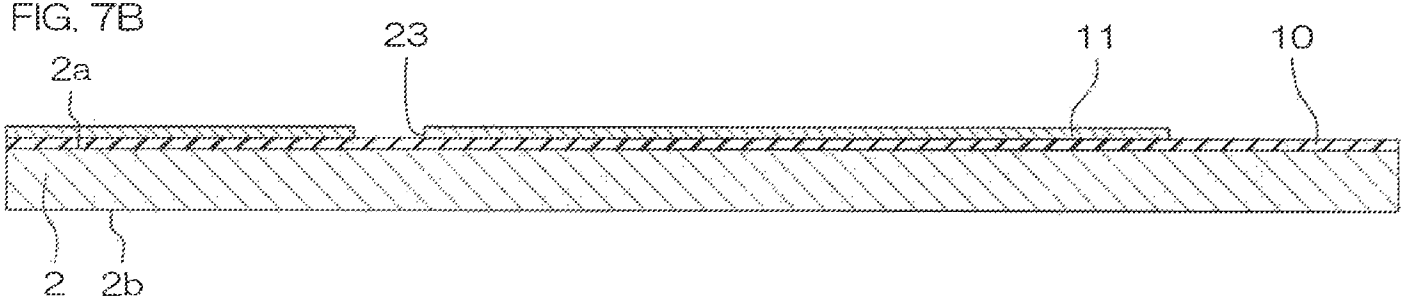
FIG. 7B is a sectional view of a step subsequent to that of FIG. 7A.
Figure 7C:
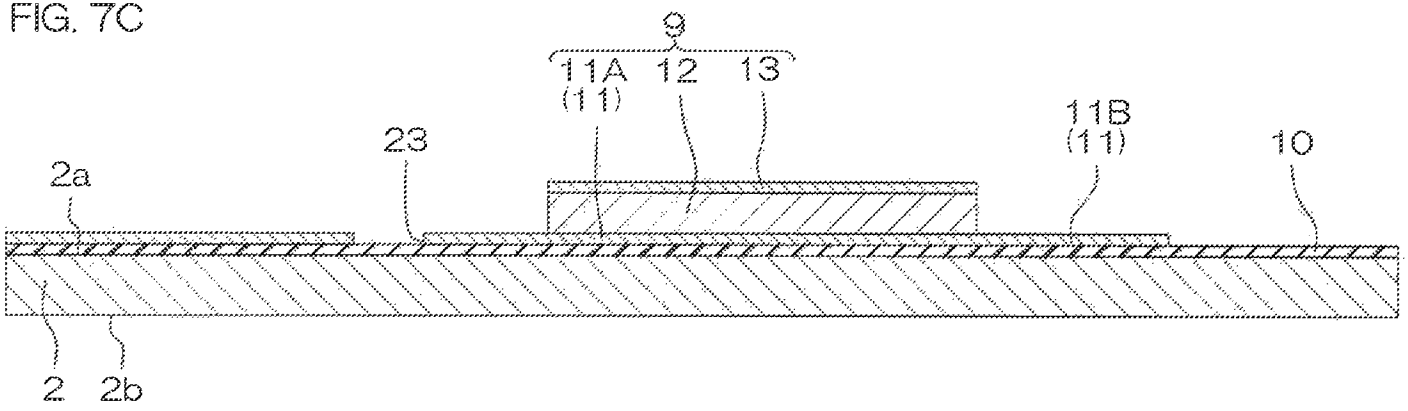
FIG. 7C is a sectional view of a step subsequent to that of FIG. 7B.

Next, a lower electrode film, which is a material layer of the lower electrode 11, is formed above the movable film formation layer 10 (above the base oxide film in the case where the base oxide film is formed). The lower electrode film is constituted, for example, of a Pt/Ti laminated film having a Ti film (for example, of 10 nm to 40 nm thickness) as a lower layer and a Pt film (for example, of 10 nm to 400 nm thickness) as an upper layer. Such a lower electrode film may be formed by a sputtering method. Thereafter, a resist mask with a pattern of the lower electrode 11 is formed by photolithography. Then, as shown in FIG. 7B, the lower electrode film is etched using the resist mask as a mask to form the lower electrode 11 of the predetermined pattern. The lower electrode 11, constituted of the main electrode portions 11A and the extension portion 11B having the penetrating holes 23, is thereby formed.

Next, a material film (piezoelectric material film) of the piezoelectric film 12 is formed on an entire surface above the lower electrode film. Specifically, for example, a piezoelectric material film of 1 μm to 3 μm thickness is formed by a sol-gel method. Such a piezoelectric material film is constituted of a sintered body of metal oxide crystal grains. Next, an upper electrode film, which is a material of the upper electrodes 13, is formed on an entire surface of the piezoelectric material film. The upper electrode film may, for example, be a single film of platinum (Pt). The upper electrode film may, for example, be an $IrO_2$/Ir laminated film having an $IrO_2$ film (for example, of 40 nm to 160 nm thickness) as a lower layer and an Ir film (for example, of 40 nm to 160 nm thickness) as an upper layer. Such an upper electrode film may be formed by the sputtering method.

Next, a resist mask with a pattern of the upper electrodes 13 is formed by photolithography. Then, as shown in FIG.

7C, the upper electrode film and the piezoelectric material film are etched successively using the resist mask as a mask to form the upper electrodes 13 and the piezoelectric films 12 of the predetermined pattern. The piezoelectric elements 9, constituted of the main electrode portions 11A of the lower electrode 11, the piezoelectric films 12, and the upper electrodes 13, are thereby formed.

Figure 7D:
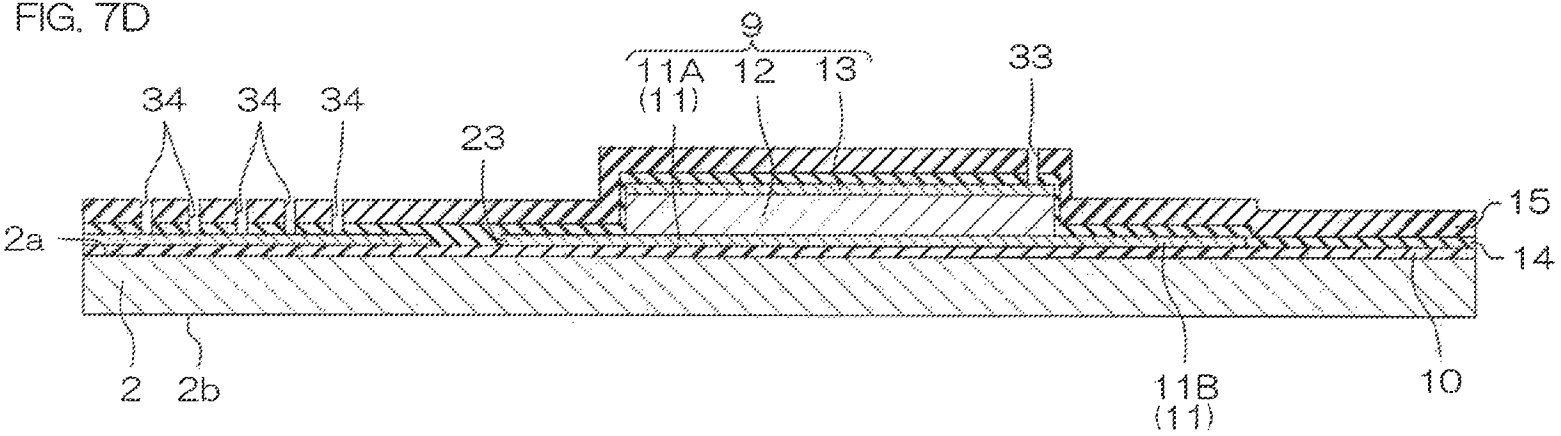
FIG. 7D is a sectional view of a step subsequent to that of FIG. 7C.

Next, after peeling off the resist mask, the hydrogen barrier film 14 covering the entire surface is formed as shown in FIG. 7D. The hydrogen barrier film 14 may be an $Al_2O_3$ film formed by the sputtering method and may have a film thickness of 50 nm to 100 nm. Thereafter, the insulating film 15 is formed above the entire surface of the hydrogen barrier film 14. The insulating film 15 may be an $SiO_2$ film and may have a film thickness of 200 nm to 300 nm. Next, the contact holes 33 and 34 are formed by successively etching the insulating film 15 and the hydrogen barrier film 14.

Figure 7E:
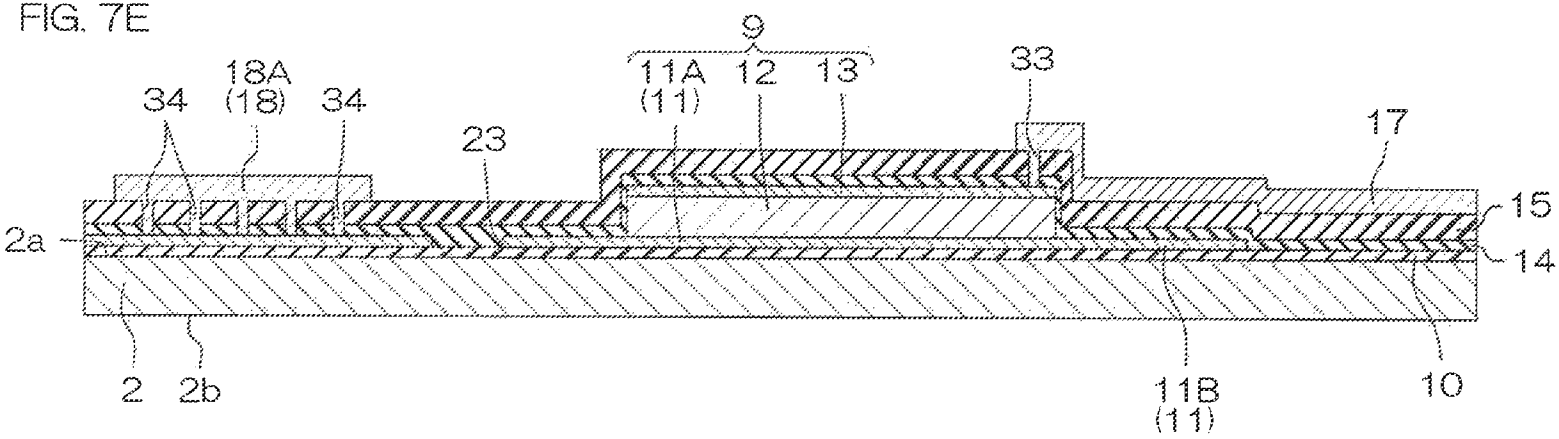
FIG. 7E is a sectional view of a step subsequent to that of FIG. 7D.

Next, as shown in FIG. 7E, a wiring film (Au film) that constitutes the upper wirings 17 and the lower wiring 18 is formed by the sputtering method above the insulating film 15 as well as inside the contact holes 33 and 34. Thereafter, the wiring film is patterned by photolithography and etching to form the upper wirings 17 and the lower wiring 18 at the same time. The upper wirings 17 and the lower wiring 18 may be formed using a bump forming method.

Figure 7F:
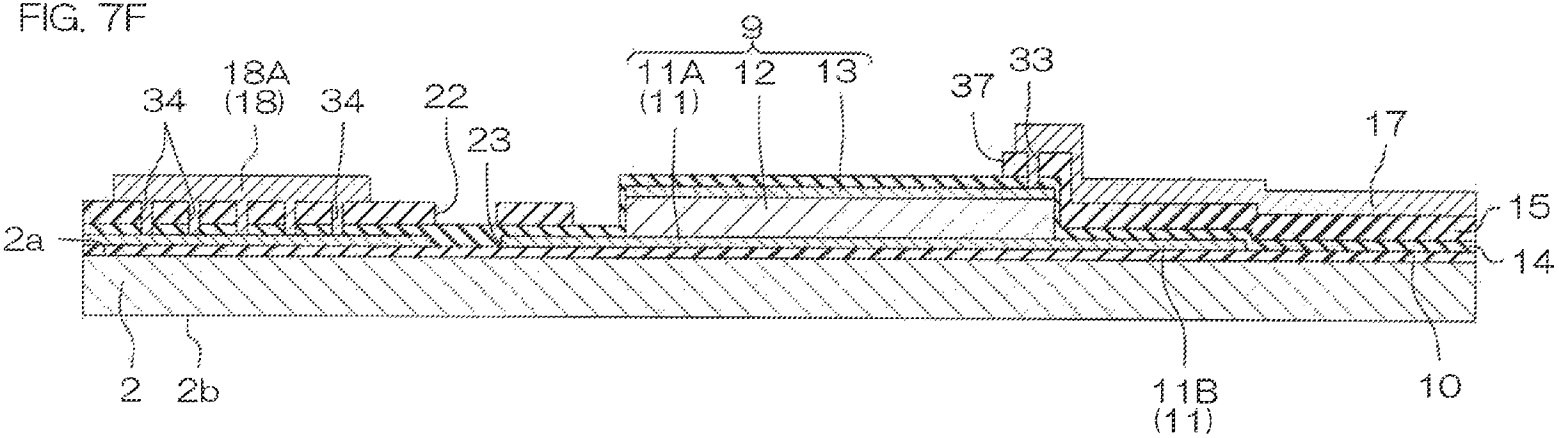
FIG. 7F is a sectional view of a step subsequent to that of FIG. 7E.

Next, a resist mask, having openings corresponding to the openings 37 and the ink supply penetrating holes 22, is formed by photolithography, and the insulating film 15 is etched using the resist mask as a mask. The openings 37 and the ink supply penetrating holes 22 are thereby formed in the insulating film 15 as shown in FIG. 7F.

Figure 7G:
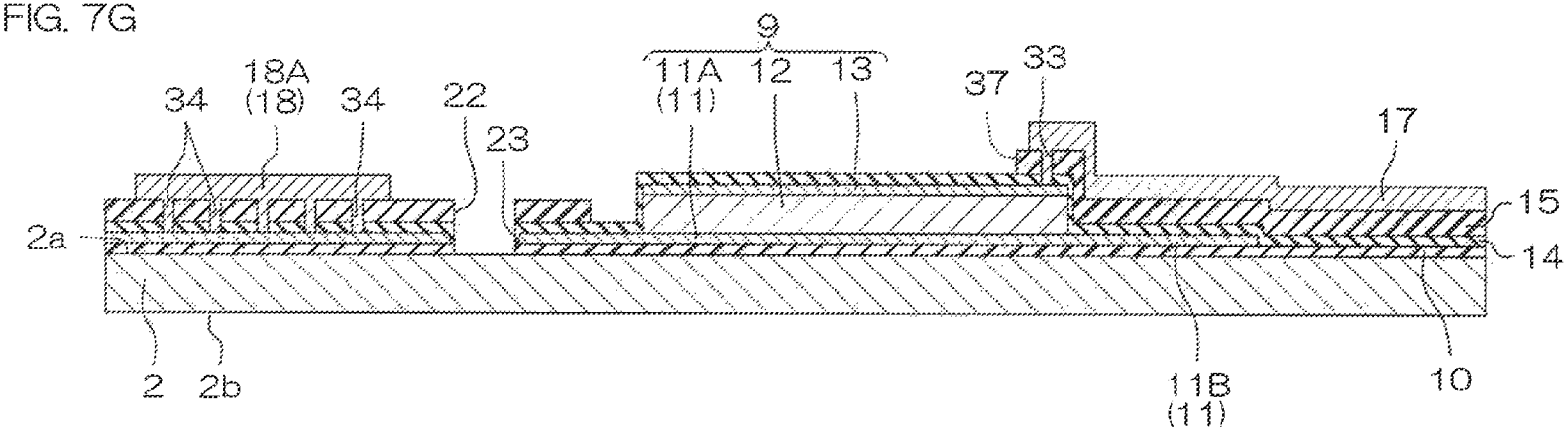
FIG. 7G is a sectional view of a step subsequent to that of FIG. 7F.

Next, the resist mask is peeled off. A resist mask having openings corresponding to the ink supply penetrating holes 22 is then formed by photolithography, and the hydrogen barrier film 14 and the movable film formation layer 10 are etched using the resist mask as a mask. The ink supply penetrating holes 22 are thereby formed in the hydrogen barrier film 14 and the movable film formation layer 10 as shown in FIG. 7G.

Figure 7H:
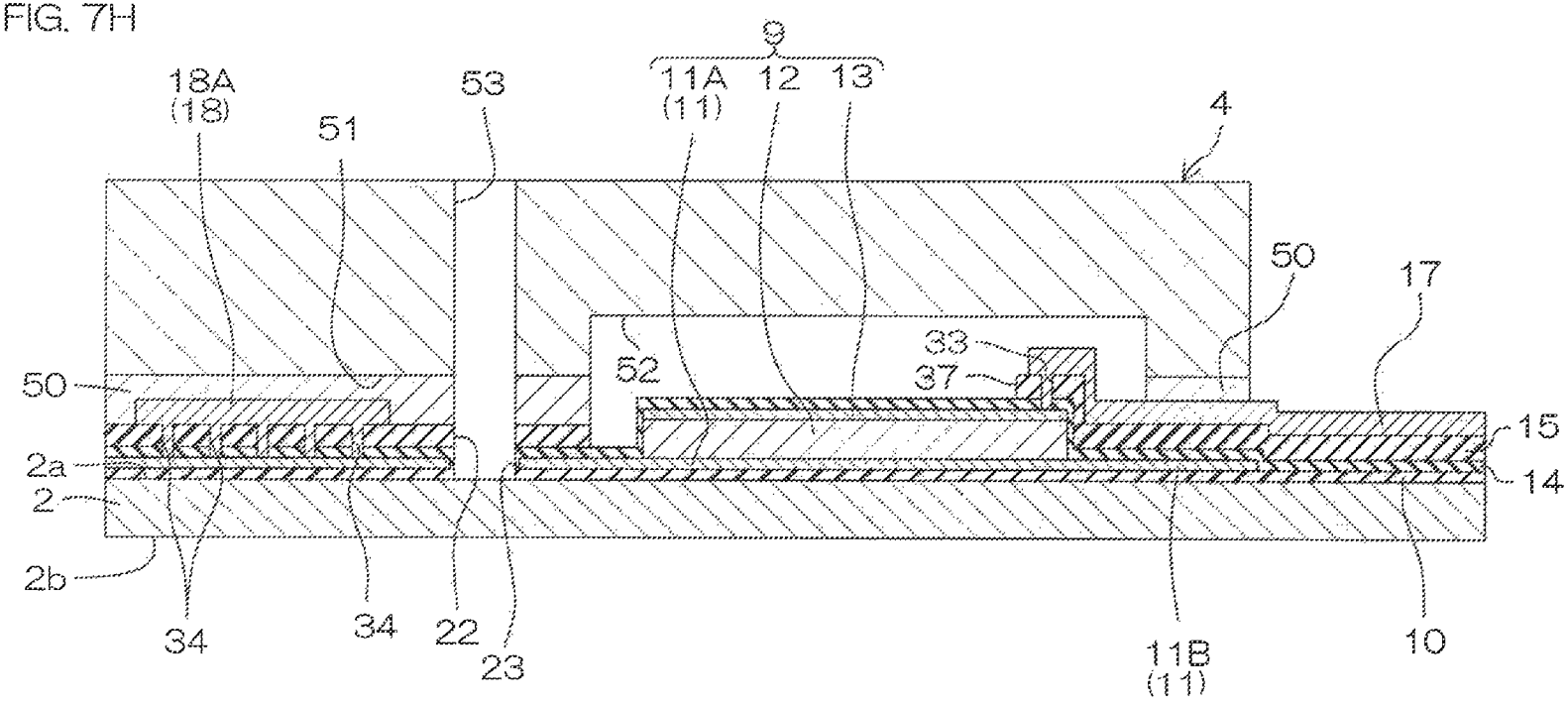
FIG. 7H is a sectional view of a step subsequent to that of FIG. 7G.

Next, as shown in FIG. 7H, an adhesive 50 is coated onto the facing surface 51 of the protective substrate 4 and the protective substrate 4 is fixed onto the actuator substrate 2 so that the ink supply passages 53 and the ink supply penetrating holes 22 are matched.

Figure 7I:
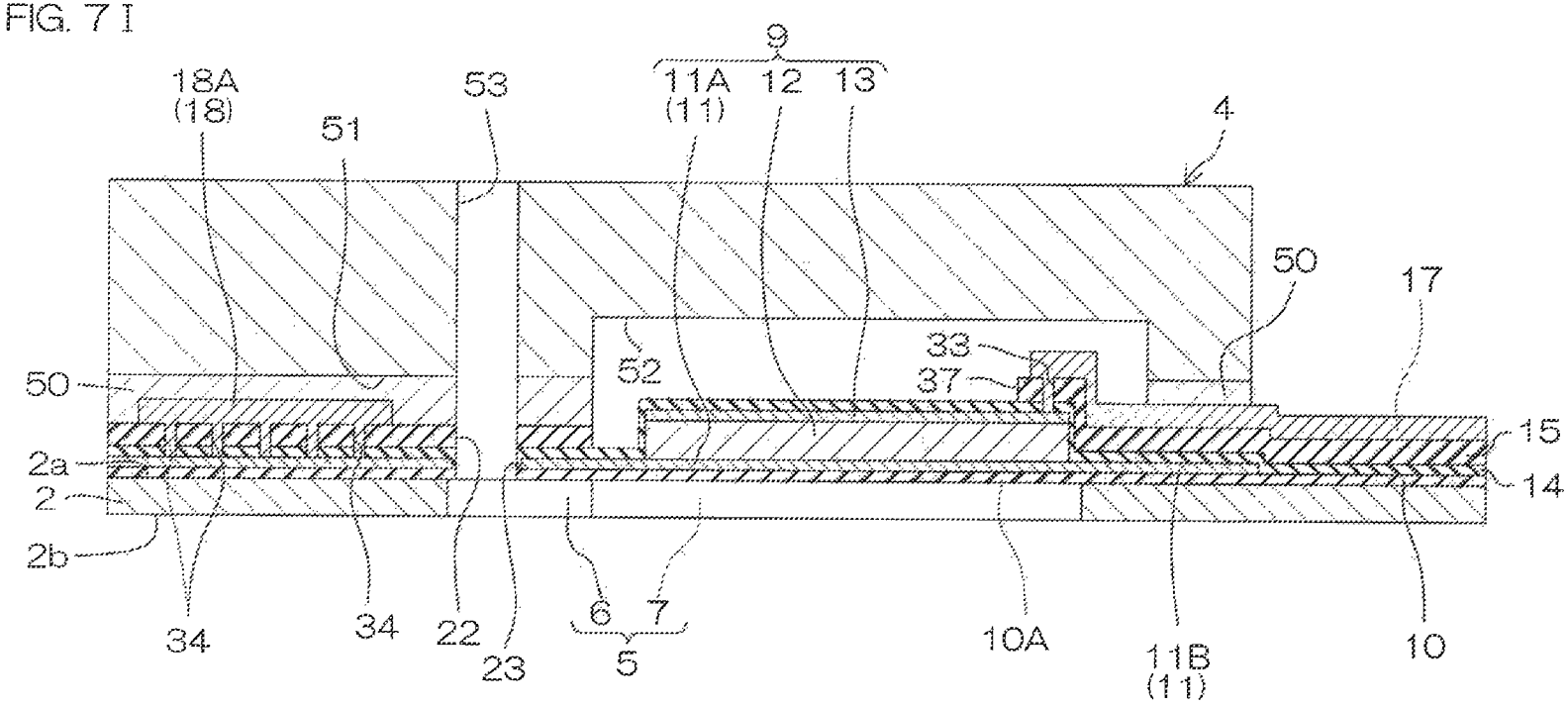
FIG. 7I is a sectional view of a step subsequent to that of FIG. 7H.

Next, as shown in FIG. 7I, rear surface grinding for thinning the actuator substrate 2 is performed. The actuator substrate 2 is made thin by the actuator substrate 2 being ground from the rear surface 2*b*. For example, the actuator substrate 2 with a thickness of approximately 670 μm in the initial state may be thinned to a thickness of approximately 300 μm. Next, etching (dry etching or wet etching) from the rear surface of the actuator substrate 2 is performed on the actuator substrate 2 to form the ink flow passages 5 (the ink inflow portions 6 and the pressure chambers 7).

In the etching process, the base oxide film formed on the front surface of the movable film formation layer 10 prevents the escaping of metal elements (Pb, Zr, and Ti in the case of PZT) from the piezoelectric film 12 and keeps the piezoelectric characteristics of the piezoelectric film 12 in a satisfactory state. Also as mentioned above, the base oxide film formed on the front surface of the movable film formation layer 10 contributes to maintaining the durability of the silicon layer that forms each movable film 10A.

Figure 7J:
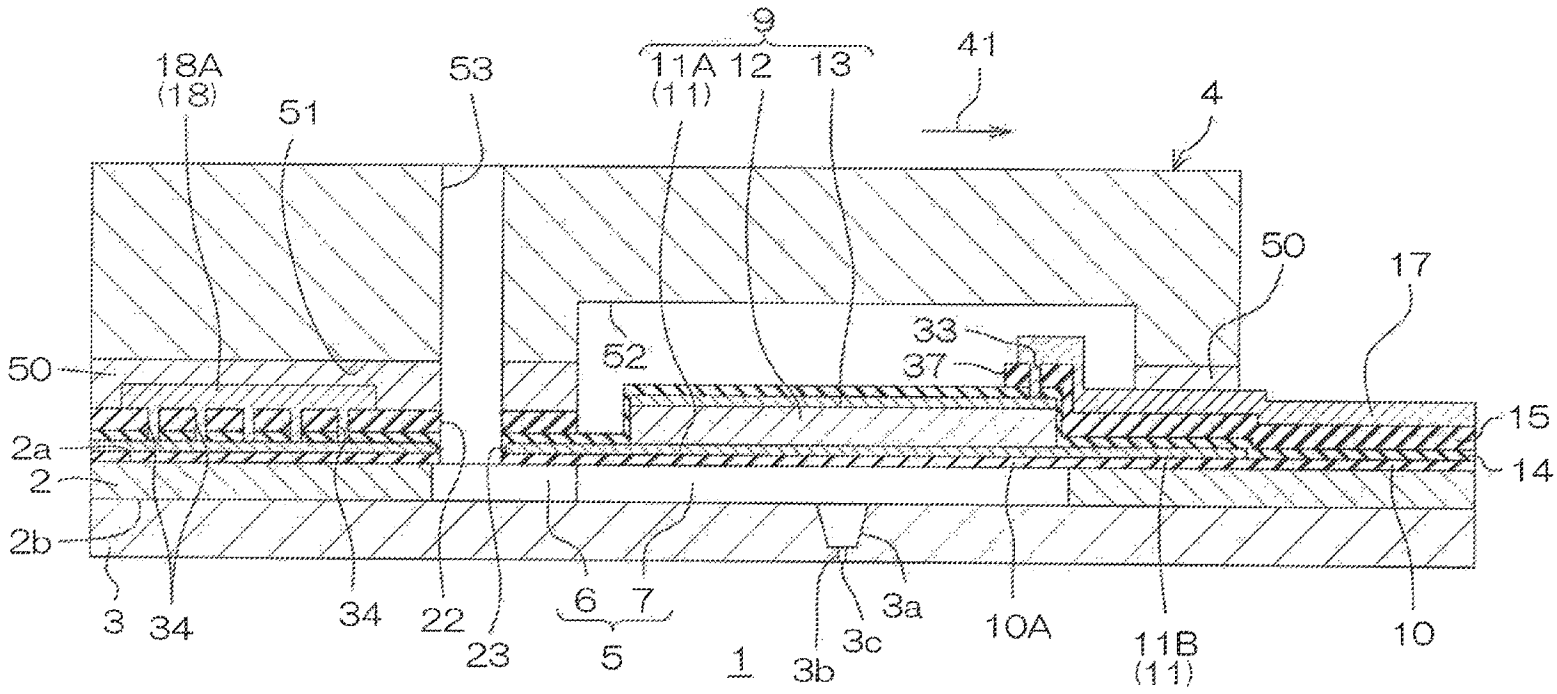
FIG. 7J is a sectional view of a step subsequent to that of FIG. 7I.

Thereafter, as shown in FIG. 7J, the nozzle substrate 3 is adhered onto the rear surface of the actuator substrate 2 and the inkjet printing head 1 is thereby obtained.

With the first preferred embodiment described above, the upper wirings 17 arranged to connect the upper electrodes 13 to the drive circuit are constituted from one type of wiring. Similarly, the lower wiring 18 arranged to connect the lower electrode 11 to the drive circuit is also constituted from one type of wiring. Therefore, in comparison to the inkjet printing head according to the reference example, processes for forming the upper wirings and the lower wiring are made simple. Manufacture of the inkjet printing head is thus made simple in comparison to the inkjet printing head according to the reference example.

Also with the first preferred embodiment, the upper wirings 17 and the lower wiring 18 are made of gold, which is high in corrosion resistance, and therefore a passivation film for protecting the wirings 17 and 18 is not provided. The manufacture of the inkjet printing head is thus made simpler.

Figure 8A:
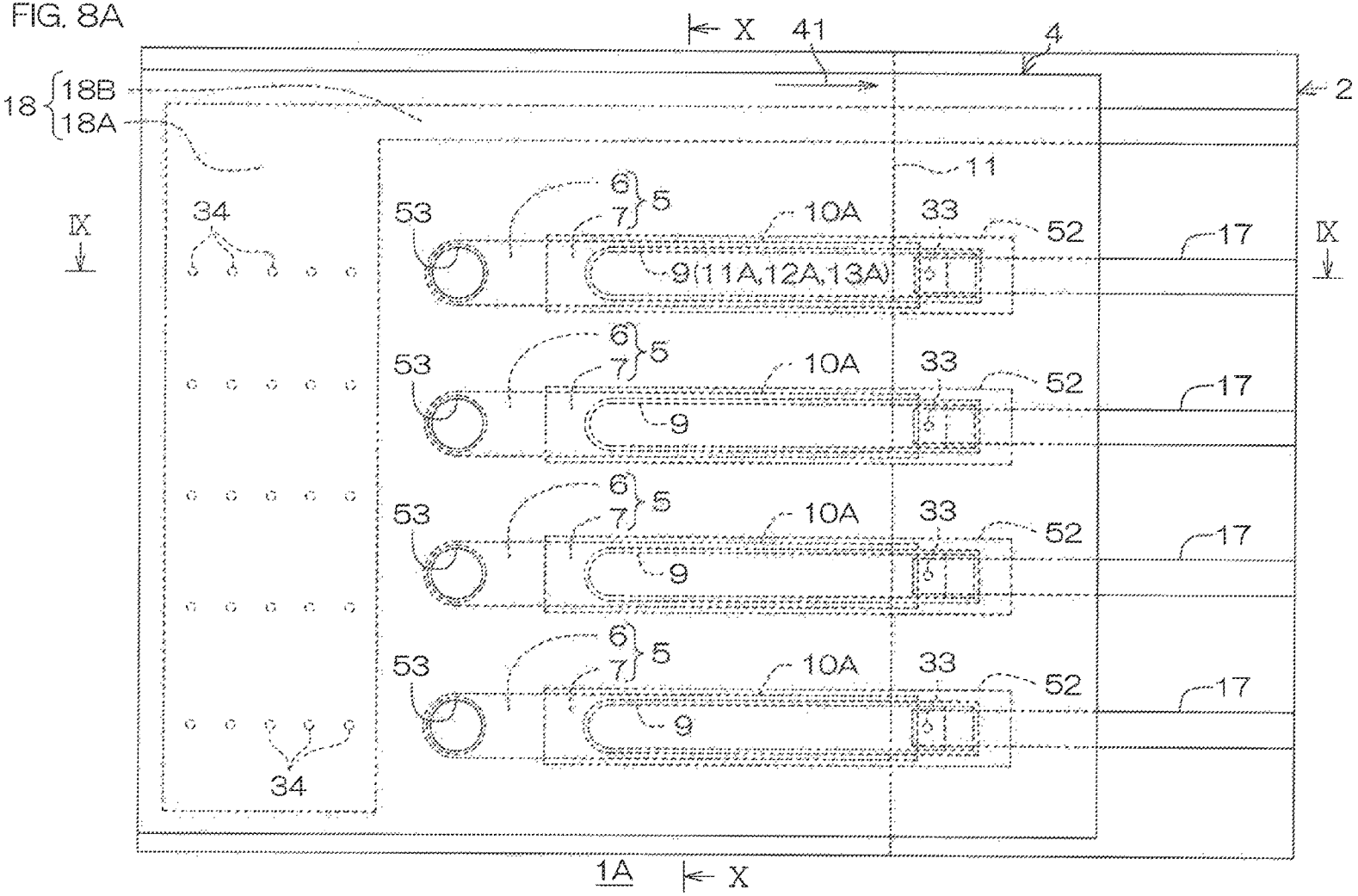
FIG. 8A is an illustrative plan view for describing the arrangement of a main portion of an inkjet printing head according to a second preferred embodiment of the present invention.
Figure 8B:
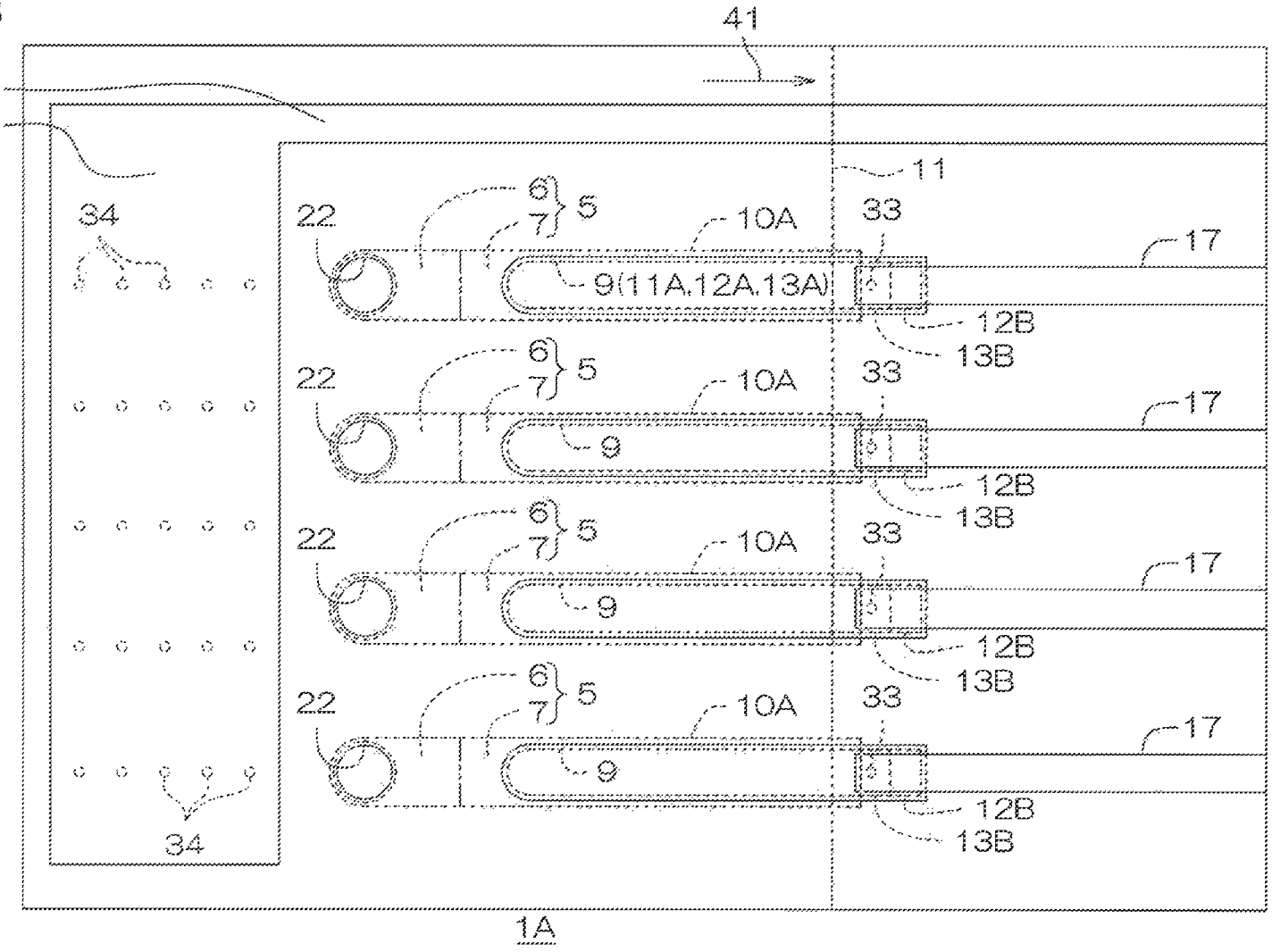
FIG. 8B is an illustrative plan view of the main portion of the inkjet printing head of FIG. 8A and is a plan view with a protective substrate omitted.
Figure 9:
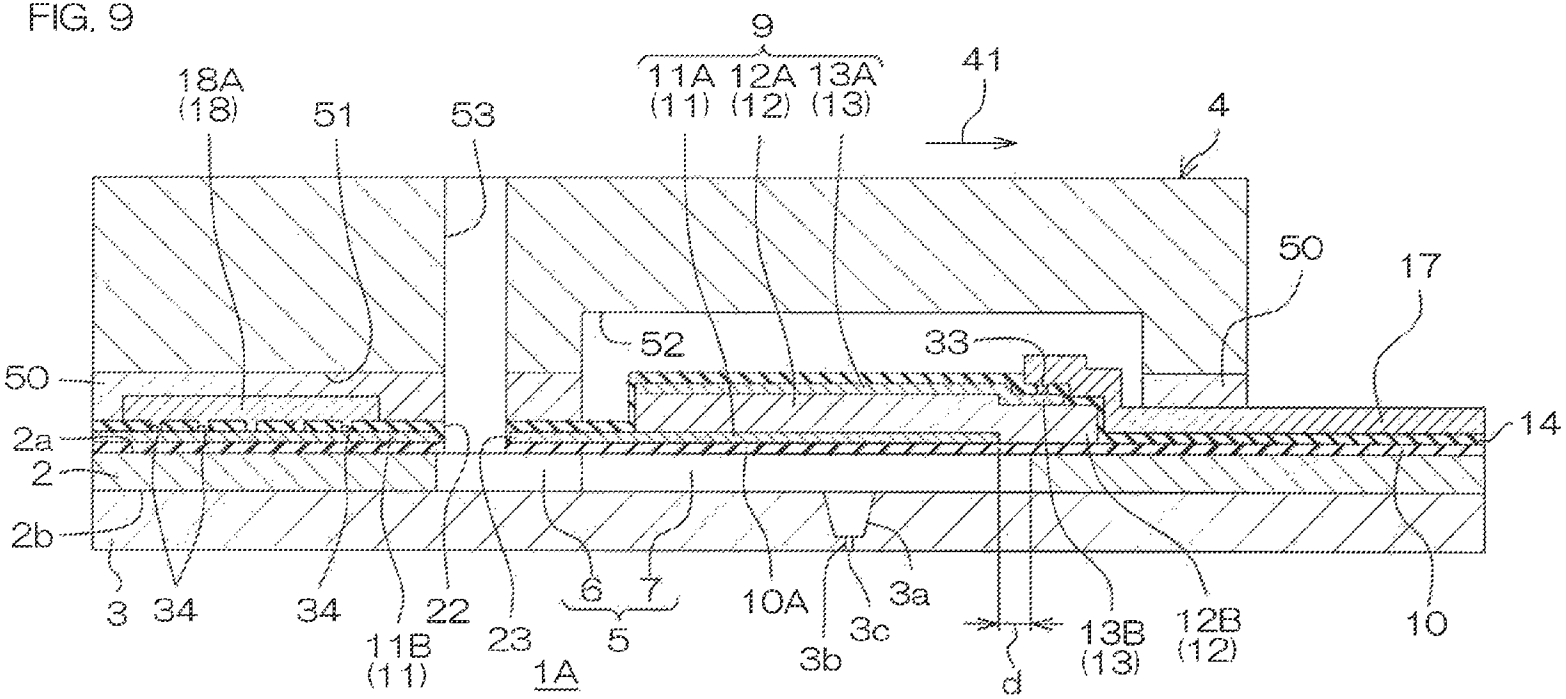
FIG. 9 is an illustrative sectional view taken along line IX-IX in FIG. 8A.
Figure 10:
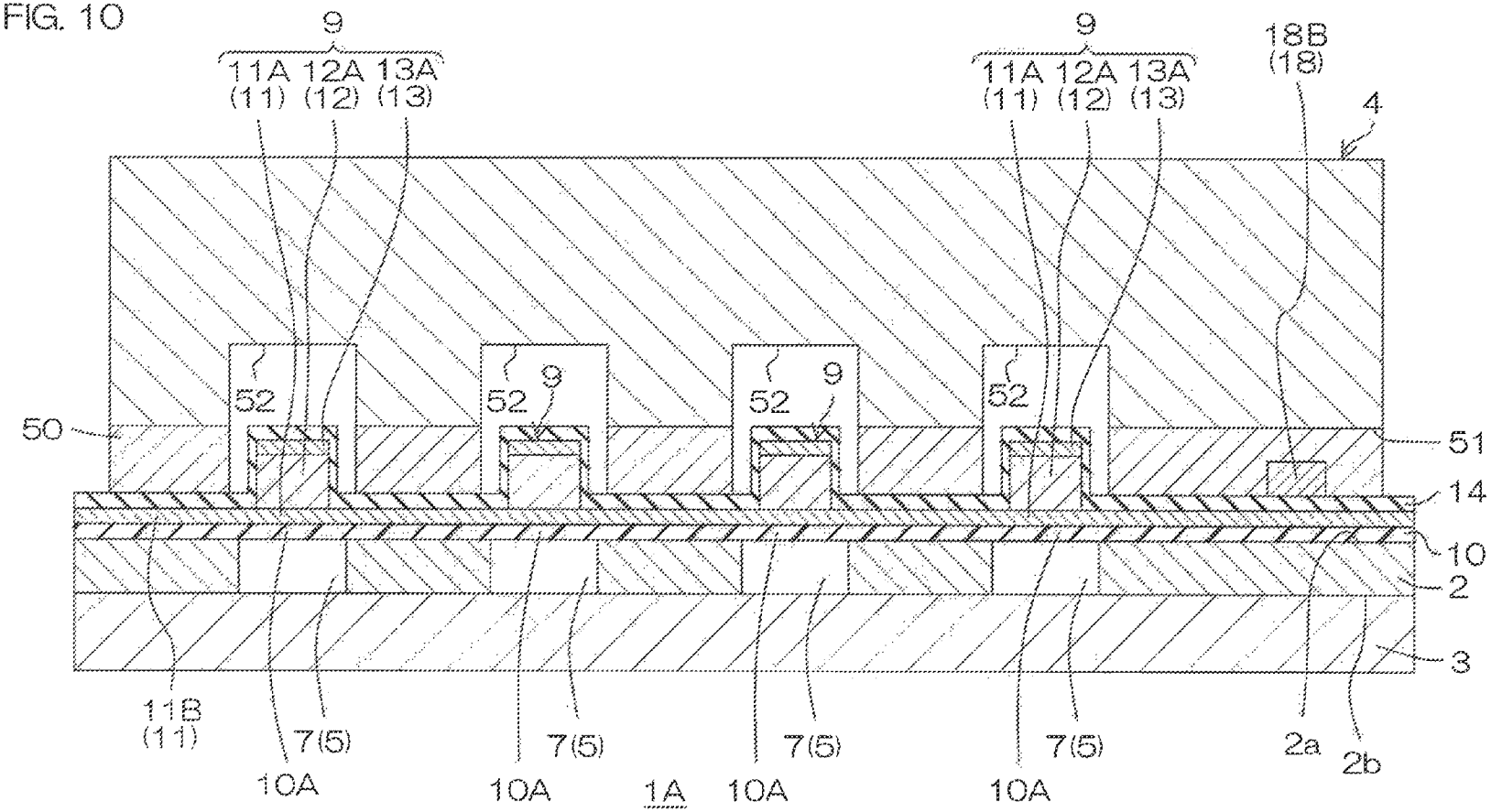
FIG. 10 is an illustrative enlarged sectional view of a portion of a section taken along line X-X in FIG. 8A.
Figure 11:
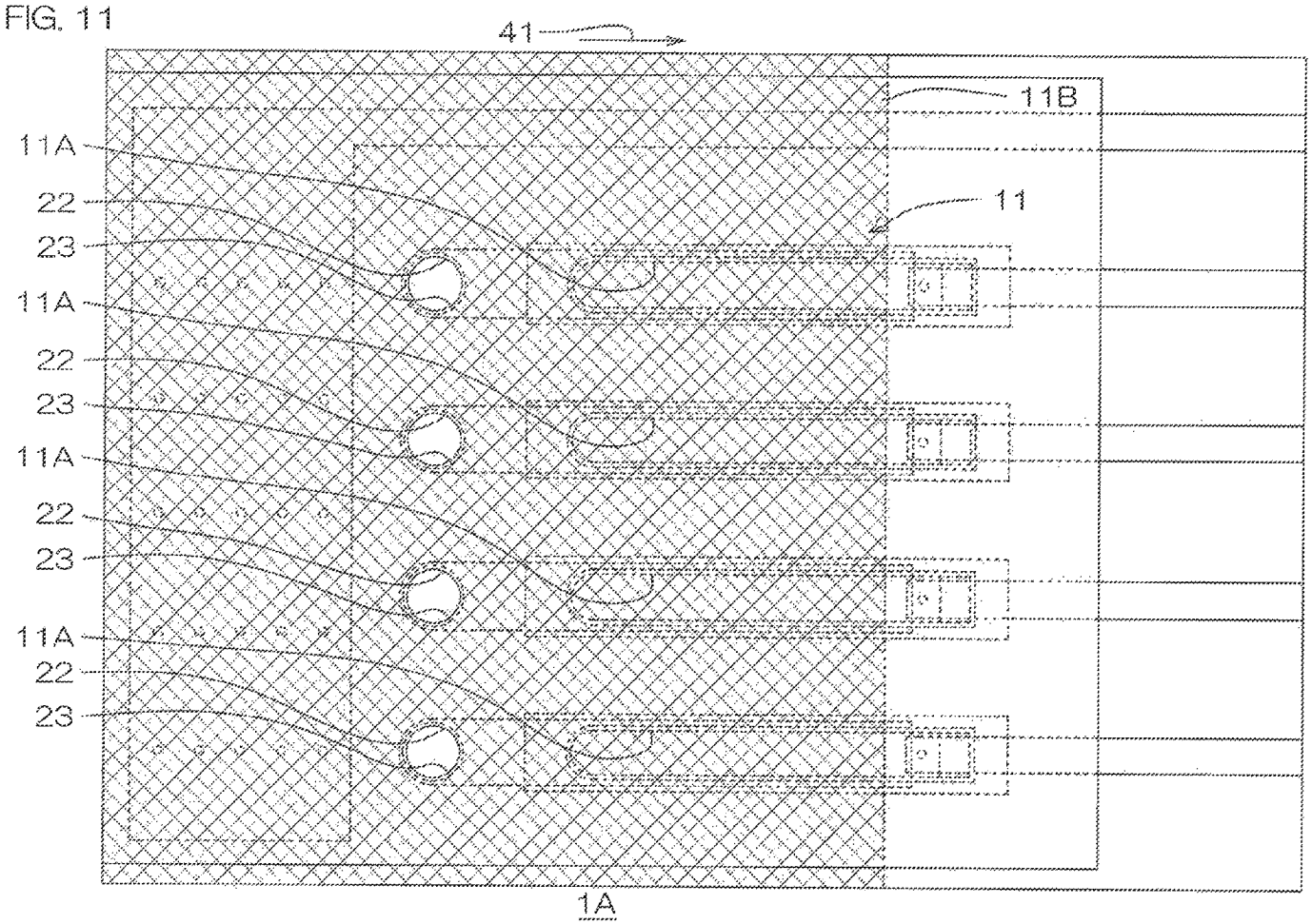
FIG. 11 is an illustrative plan view of a pattern example of a lower electrode of the inkjet printing head.
Figure 12:
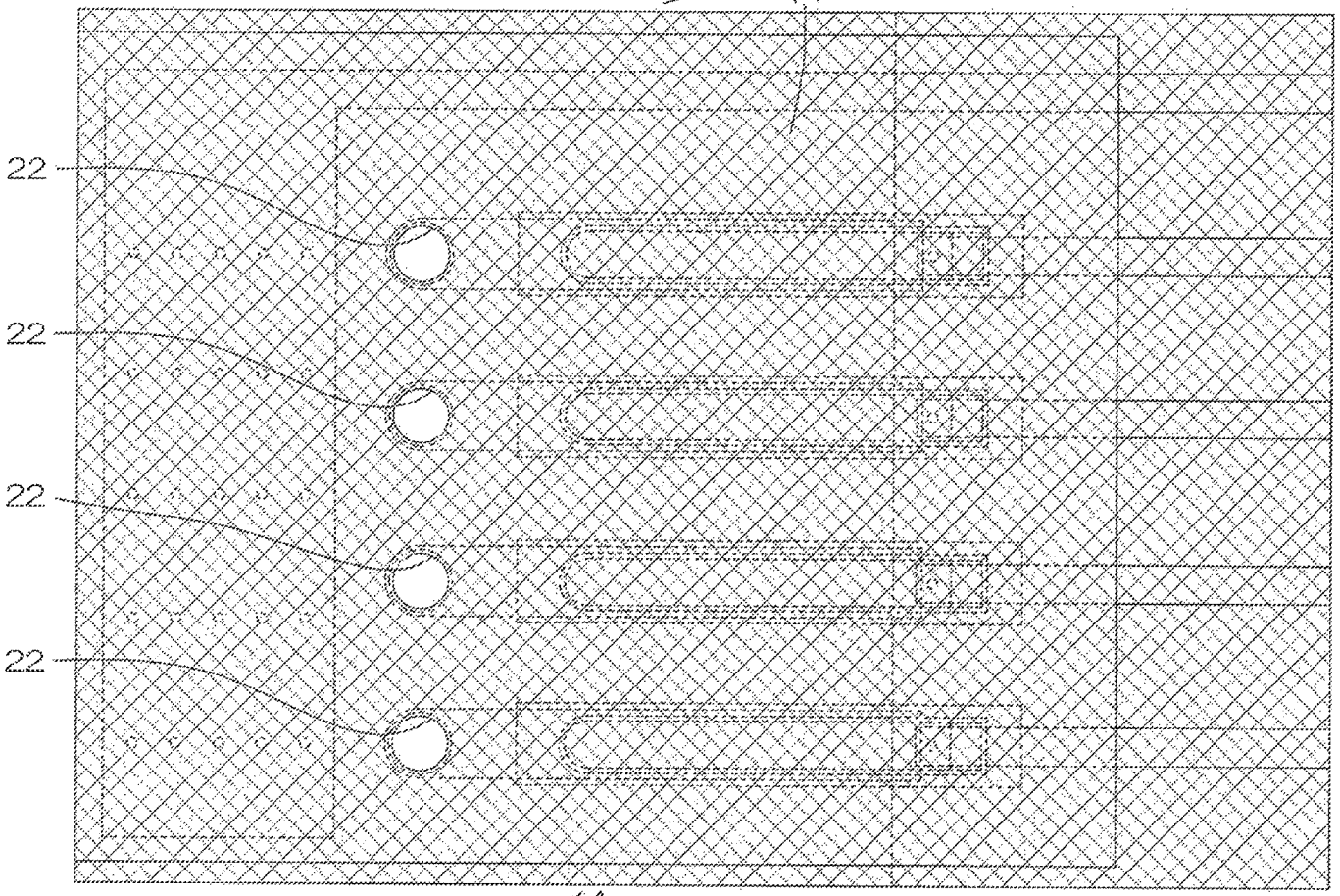
FIG. 12 is an illustrative plan view of a pattern example of a hydrogen barrier film of the inkjet printing head.
Figure 13:
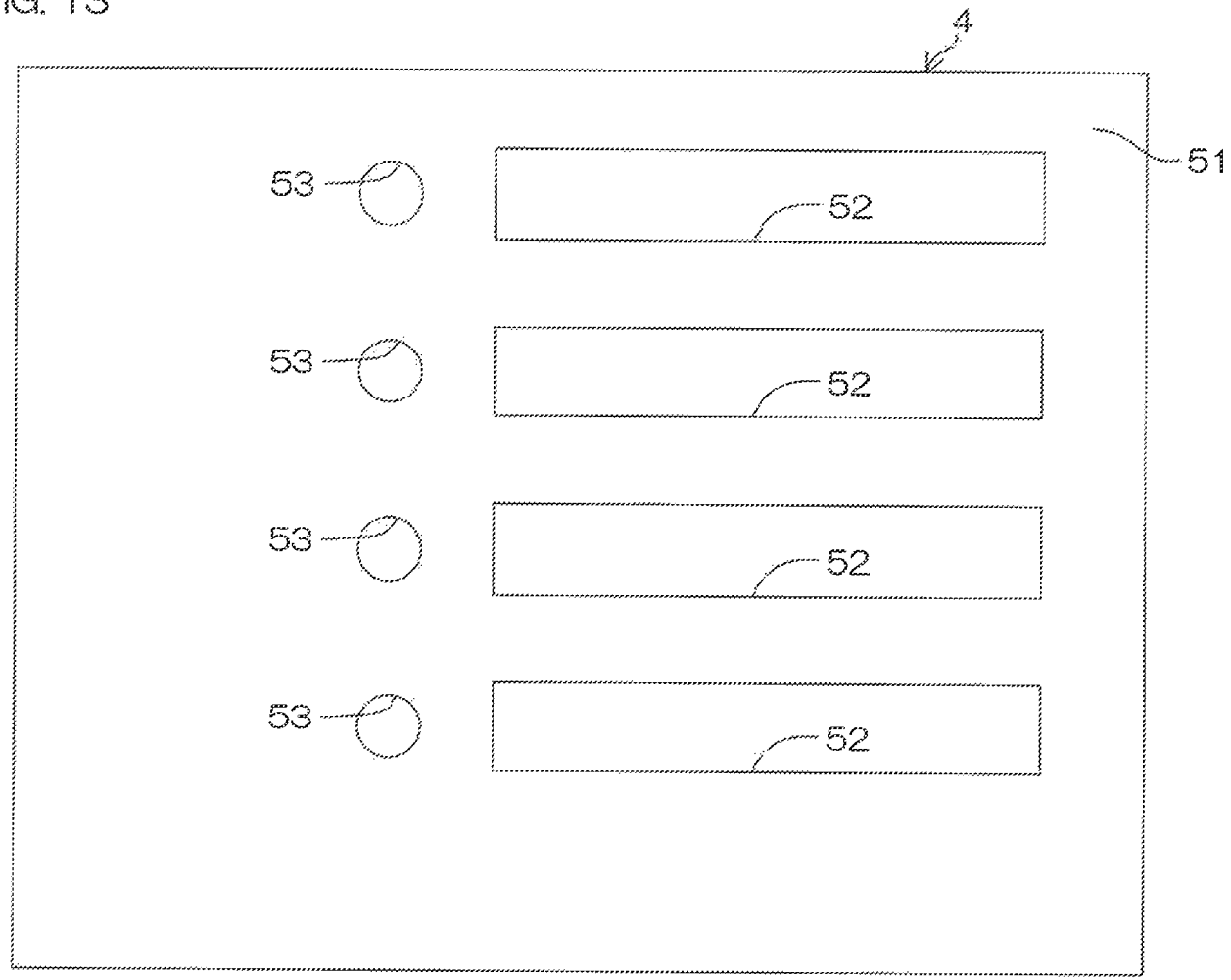
FIG. 13 is a bottom view of a main portion of the protective substrate as viewed from an actuator substrate side of the inkjet printing head.

FIG. 8A is an illustrative plan view for describing the arrangement of a main portion of an inkjet printing head according to a second preferred embodiment of the present invention. FIG. 8B is an illustrative plan view of the main portion of the inkjet printing head 1A and is a plan view with a protective substrate omitted. FIG. 9 is an illustrative sectional view taken along line IX-IX in FIG. 8A. FIG. 10 is an illustrative enlarged sectional view of a portion of a section taken along line X-X in FIG. 8A. FIG. 11 is an illustrative plan view of a pattern example of a lower electrode of the inkjet printing head. FIG. 12 is an illustrative plan view of a pattern example of a hydrogen barrier film of the inkjet printing head. FIG. 13 is a bottom view of a main portion of the protective substrate as viewed from an actuator substrate side of the inkjet printing head.

In FIG. 8A, FIG. 8B, FIG. 9, and FIG. 10, portions corresponding to respective portions shown in FIG. 1A, FIG. 1B, FIG. 2, and FIG. 3 shall be indicated by attaching the same reference symbols.

In comparison to the inkjet printing head 1 according to the first preferred embodiment, the inkjet printing head 1A according to the second preferred embodiment differs in the point of being different in the patterns of the lower electrode 11, the piezoelectric films 12, and the upper electrodes 13 and in the point of not being provided with an insulating film. These points shall now be described.

In FIG. 8B and FIG. 9, a boundary between each ink inflow portion 6 and the corresponding pressure chamber 7 is indicated by an alternate long and two short dashes line. Mainly referring to FIG. 9, the piezoelectric elements 9 are disposed on a front surface of the movable film 10A. The piezoelectric elements 9 include the lower electrode 11 formed above the movable film formation layer 10, the piezoelectric films 12 formed above the lower electrode 11, and the upper electrodes 13 formed above the piezoelectric films 12. In plan view, each piezoelectric element 9 is constituted of a portion at which the lower electrode 11, the corresponding piezoelectric film 12, and the corresponding upper electrode 13 overlap.

Mainly referring to FIG. 8B, each piezoelectric element 9 has, in plan view, a rectangular shape that is long in the long direction of the corresponding pressure chamber 7 (movable film 10A). The length in the long direction of the piezoelectric element 9 is shorter than the length in the long direction of the pressure chamber 7 (movable film 10A). The respective end edges along the short direction of the piezoelectric element 9 are disposed at inner sides at predetermined intervals respectively from the respective corresponding end edges of the movable film 10A. Also, the width in the short direction of the piezoelectric element 9 is narrower than the width in the short direction of the movable film 10A. The respective side edges along the long direction of the piezoelectric element 9 are disposed at inner sides at predetermined intervals from the respective corresponding side edges of the movable film 10A.

The lower electrode 11 includes the main electrode portions 11A of rectangular shape in plan view that constitute the piezoelectric elements 9 and the extension portion 11B led out from the main electrode portions 11A in directions along the front surface of the movable film formation layer 10 to extend outside the peripheral edges of the top surface portions of the pressure chambers 7. Referring to FIG. 9 and FIG. 11, the lower electrode 11 is formed on substantially the entirety of the front surface of the main portion of the movable film formation layer 10. However, a downstream side end in the ink flow direction 41 of the lower electrode 11 is positioned further upstream than the downstream side ends in the ink flow direction 41 of the pressure chambers 7 by just a predetermined interval d. The extension portion 11B is the region of the entire region of the lower electrode 11 excluding the main electrode portions 11A (see FIG. 11).

Each piezoelectric film 12 includes an active portion 12A of rectangular shape in plan view contacting the upper surface of the corresponding main electrode portion 11A of the lower electrode 11 and an inactive portion 12B of rectangular shape in plan view extending downstream from a downstream side end in the ink flow direction 41 of the active portion 12A and contacting an upper surface of the movable film formation layer 10. Whereas the active portion 12A is formed above the main electrode portion 11A, the inactive portion 12B is formed above the movable film formation layer 10. A step portion is thus formed at a boundary portion between an upper surface of the active portion 12A and an upper surface of the inactive portion 12B.

Each upper electrode 13 includes a main electrode portion 13A of rectangular shape in plan view contacting the upper surface of the corresponding active portion 12A and an extension portion 13B of rectangular shape in plan view extending downstream from a downstream side end in the ink flow direction 41 of the main electrode portion 13A and contacting the upper surface of the corresponding inactive portion 12B. A step portion is formed at a boundary portion between an upper surface of the main electrode portion 13A and an upper surface of the extension portion 13B.

Referring to FIG. 9 and FIG. 12, the hydrogen barrier film 14 is formed above the extension portion 11B of the lower electrode 11 and above the piezoelectric elements 9. The hydrogen barrier film 14 is constituted, for example, of $Al_2O_3$ (alumina). In the second preferred embodiment, an insulating film is not formed above the hydrogen barrier film 14. The upper wirings 17, made of gold and arranged to connect the upper electrodes 13 to the unillustrated drive circuit (piezoelectric element driving LSI), and the lower wiring 18, made of gold and arranged to connect the lower electrode 11 to the drive circuit, are formed above the hydrogen barrier film 14.

One end portion of each upper wiring 17 is disposed above the extension portion 13B of the corresponding upper electrode 13. A contact hole 33, penetrating through the hydrogen barrier film 14, is formed between the extension portion 13B and the upper wiring 17. The one end portion of the upper wiring 17 enters into the contact hole 33 and is connected to the upper electrode 13 inside the contact hole 33. In plan view, the upper wiring 17 has the one end portion connected to the upper surface of the upper electrode 13 (the upper surface of the extension portion 13B in the present preferred embodiment) and has another end portion extending across one end of the upper electrode 13 at the extension portion 13 side to the opposite side from the main electrode portion 13A of the upper electrode 13. The tip portion of the upper wiring 17 extends downstream in the ink flow direction 41 of the protective substrate 4. The connection terminal portion (not shown) is formed at the tip portion of the upper wiring 17.

As mentioned above, the downstream side end in the ink flow direction 41 of the lower electrode 11 is positioned upstream from the downstream side ends in the ink flow direction 41 of the pressure chambers 7 by just the predetermined interval d. Therefore, in plan view, the lower electrode 11 is not present below the upper wirings 17 outside the downstream side ends in the ink flow direction 41 of the top surface portion of the pressure chambers 7. Insulation between the upper wirings 17 and the lower electrode 11 can thereby be maintained even if an insulating film is not provided between the hydrogen barrier film 14 and the upper wirings 17.

The lower wiring 18 includes the base portion 18A disposed above the extension portion 11B of the lower electrode 11 at the opposite side from the pressure chambers 7 with respect to the ink inflow portions 6 of the ink flow passages 5. The plurality of contact holes 34, penetrating through the hydrogen barrier film 14 are formed between the base portion 18A of the lower wiring 18 and the extension portion 11B of the lower electrode 11. The base portion 18A of the lower wiring 18 enters into the contact holes 34 and is connected to the extension portion 11B of the lower electrode 11 inside the contact holes 34.

Referring to FIG. 8B, the lower wiring 18 has, in plan view, the rectangular base portion 18A that is long in the direction orthogonal to the ink flow direction 41 and the lead portion 18B extending along the ink flow direction 41 from one end portion of the base portion 18A. The lead portion 18B extends from the one end portion of the base portion 18A, along one side portion of the top surface portion of each pressure chamber 7, and thereafter extends parallel to the upper wirings 17. The tip portion of the lead portion 18B extends further downstream in the ink flow direction 41 than the downstream side end of the protective substrate 4. The connection terminal portion (not shown) is formed at the tip portion of the lead portion 18B.

FIG. 14A to FIG. 14I are sectional views of an example of a manufacturing process of the inkjet printing head 1A and show a section corresponding to FIG. 2.

Figure 14A:
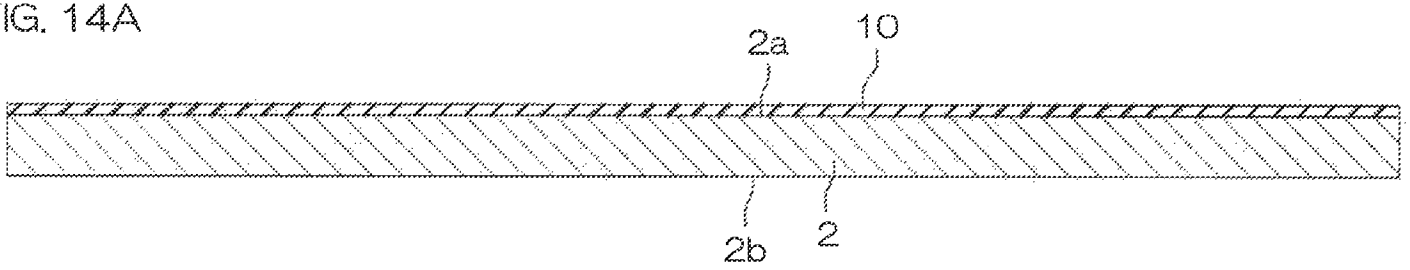
FIG. 14A is a sectional view of an example of a manufacturing process of the inkjet printing head.

First, as shown in FIG. 14A, the movable film formation layer 10 is formed on the front surface 2*a* of the actuator substrate 2. However, as the actuator substrate 2, that which is thicker than the thickness of the actuator substrate 2 at the final stage is used. Specifically, a silicon oxide film (for example, of 1.2 μm thickness) is formed on the front surface of the actuator substrate 2. If the movable film formation layer 10 is constituted of a laminated film of a silicon film, a silicon oxide film, and a silicon nitride film, the silicon film (for example, of 0.4 μm thickness) is formed on the front surface of the actuator substrate 2, the silicon oxide film (for example, of 0.4 μm thickness) is formed above the silicon film, and the silicon nitride film (for example, of 0.4 μm thickness) is formed above the silicon oxide film.

A base oxide film, for example, of $Al_2O_3$, MgO, or $ZrO_2$, etc., may be formed on the front surface of the movable film formation layer 10. Such base oxide films prevent metal atoms from escaping from the piezoelectric film 12 to be formed later. When metal electrons escape, the piezoelectric film 12 may degrade in piezoelectric characteristics. Also, when metal atoms that have escaped become mixed in the silicon layer constituting each movable film 10A, the movable film 10A may degrade in durability.

Figure 14B:
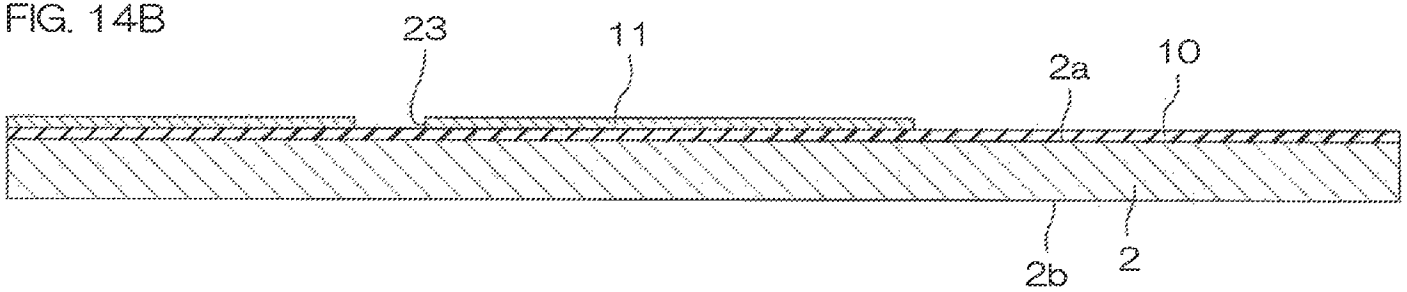
FIG. 14B is a sectional view of a step subsequent to that of FIG. 14A.

Next, a lower electrode film, which is the material layer of the lower electrode 11, is formed above the movable film formation layer 10 (above the base oxide film in the case where the base oxide film is formed). The lower electrode film is constituted, for example, of a Pt/Ti laminated film having a Ti film (for example, of 10 nm to 40 nm thickness) as a lower layer and a Pt film (for example, of 10 nm to 400 nm thickness) as an upper layer. Such a lower electrode film may be formed by a sputtering method. Thereafter, a resist mask with a pattern of the lower electrode 11 is formed by photolithography. Then, as shown in FIG. 14B, the lower electrode film is etched using the resist mask as a mask to form the lower electrode 11 of the predetermined pattern. The lower electrode 11, constituted of the main electrode portions 11A and the extension portion 11B having the penetrating holes 23, is thereby formed.

Next, a material film (piezoelectric material film) of the piezoelectric film 12 is formed above the movable film formation layer 10 so as to cover the lower electrode 11. Specifically, for example, a piezoelectric material film of 1 μm to 3 μm thickness is formed by the sol-gel method. Such a piezoelectric material film is constituted of a sintered body of metal oxide crystal grains. Next, an upper electrode film, which is the material of the upper electrodes 13, is formed on the entire surface of the piezoelectric material film. The upper electrode film may, for example, be a single film of platinum (Pt). The upper electrode film may, for example, be an $IrO_2$/Ir laminated film having an $IrO_2$ film (for example, of 40 nm to 160 nm thickness) as a lower layer and an Ir film (for example, of 40 nm to 160 nm thickness) as an upper layer. Such an upper electrode film may be formed by the sputtering method.

Figure 14C:
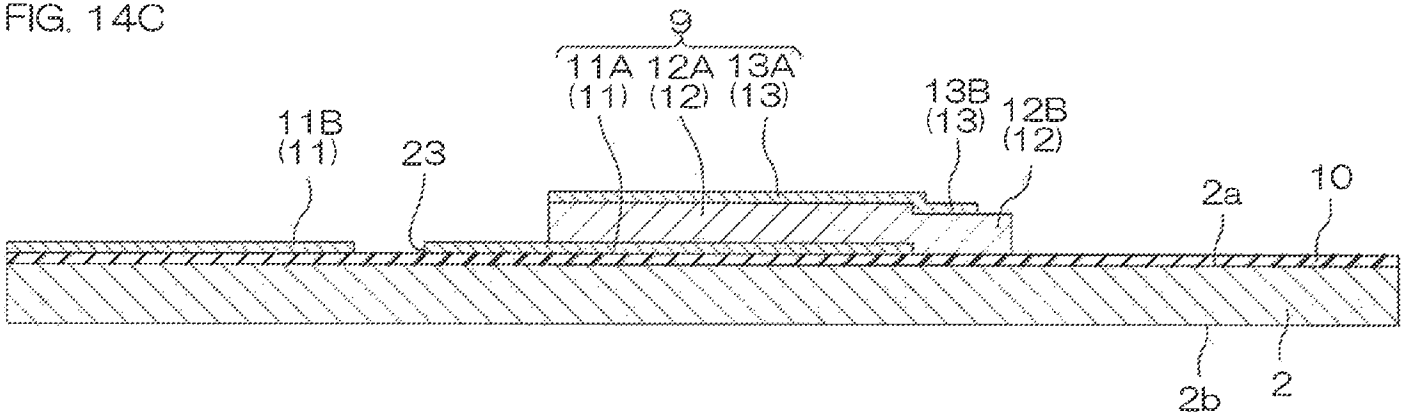
FIG. 14C is a sectional view of a step subsequent to that of FIG. 14B.

Next, a resist mask with a pattern of the upper electrodes 13 is formed by photolithography. Then, as shown in FIG. 14C, the upper electrode film and the piezoelectric material film are etched successively using the resist mask as a mask to form the upper electrodes 13 and the piezoelectric films 12 of the predetermined pattern. The upper electrodes 13, constituted of the main electrode portions 13A and the extension portions 13B, and the piezoelectric films 12, constituted of the active portions 12A and the inactive portions 12B, are thereby formed. The piezoelectric elements 9, constituted of the main electrode portions 11A of the lower electrode 11, the active portions 12A of the piezoelectric films 12, and the main electrode portions 13A of the upper electrodes 13, are thereby formed.

Figure 14D:
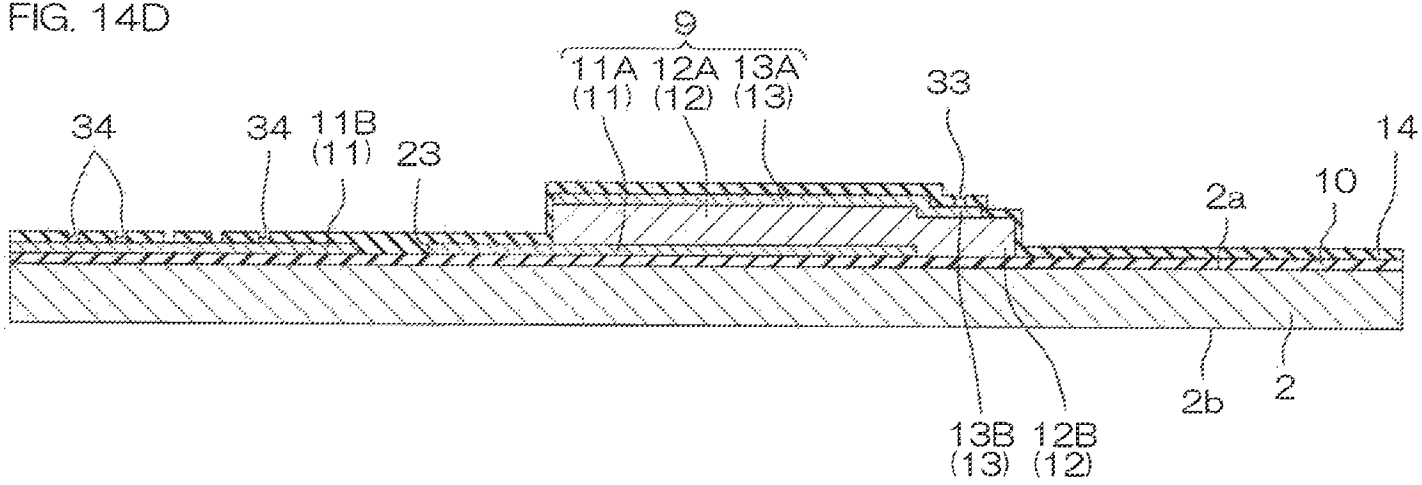
FIG. 14D is a sectional view of a step subsequent to that of FIG. 14C.

Next, after peeling off the resist mask, the hydrogen barrier film 14 covering the entire surface is formed as shown in FIG. 14D. The hydrogen barrier film 14 may be an $Al_2O_3$ film formed by the sputtering method and may have a film thickness of 50 nm to 100 nm. Thereafter, the contact holes 33 and 34 are formed by etching the hydrogen barrier film 14.

Figure 14E:
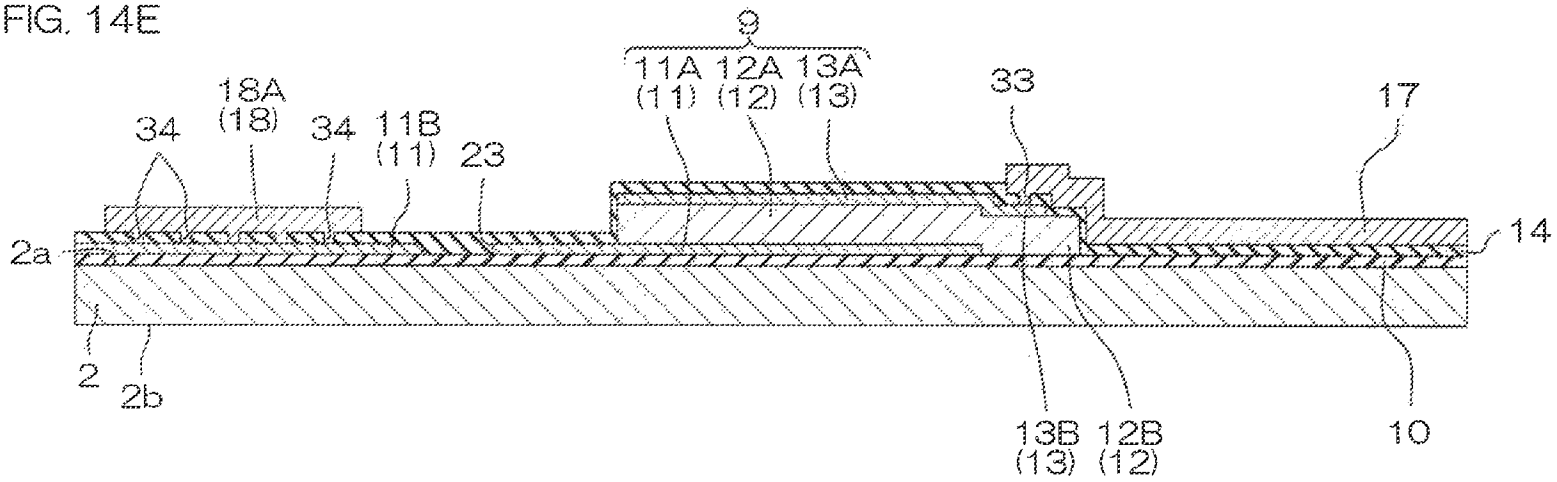
FIG. 14E is a sectional view of a step subsequent to that of FIG. 14D.

Next, as shown in FIG. 14E, a wiring film (Au film) that constitutes the upper wirings 17 and the lower wiring 18 is formed by the sputtering method above the hydrogen barrier film 14 as well as inside the contact holes 33 and 34. Thereafter, the wiring film is patterned by photolithography and etching to form the upper wirings 17 and the lower wiring 18 at the same time. The upper wirings 17 and the lower wiring 18 may be formed using a bump forming method.

Figure 14F:
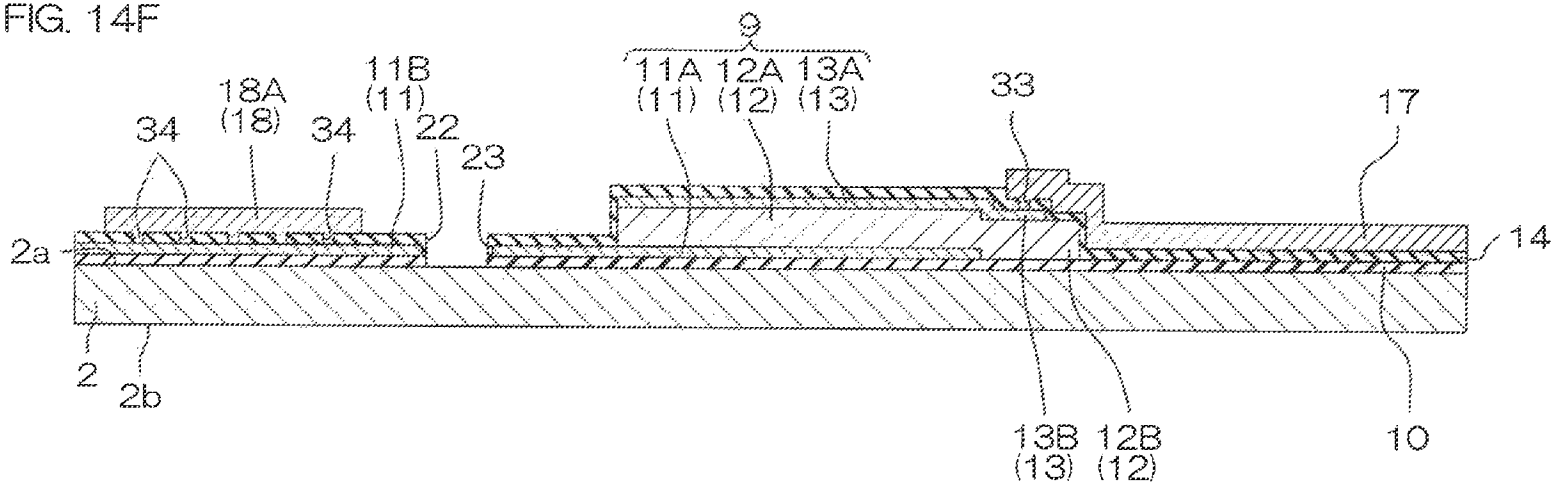
FIG. 14F is a sectional view of a step subsequent to that of FIG. 14E.

Next, a resist mask, having openings corresponding to the ink supply penetrating holes 22, is formed by photolithography, and the hydrogen barrier film 14 and the movable film formation layer 10 are etched using the resist mask as a mask. The ink supply penetrating holes 22 are thereby formed in the hydrogen barrier film 14 and the movable film formation layer 10 as shown in FIG. 14F.

Figure 14G:
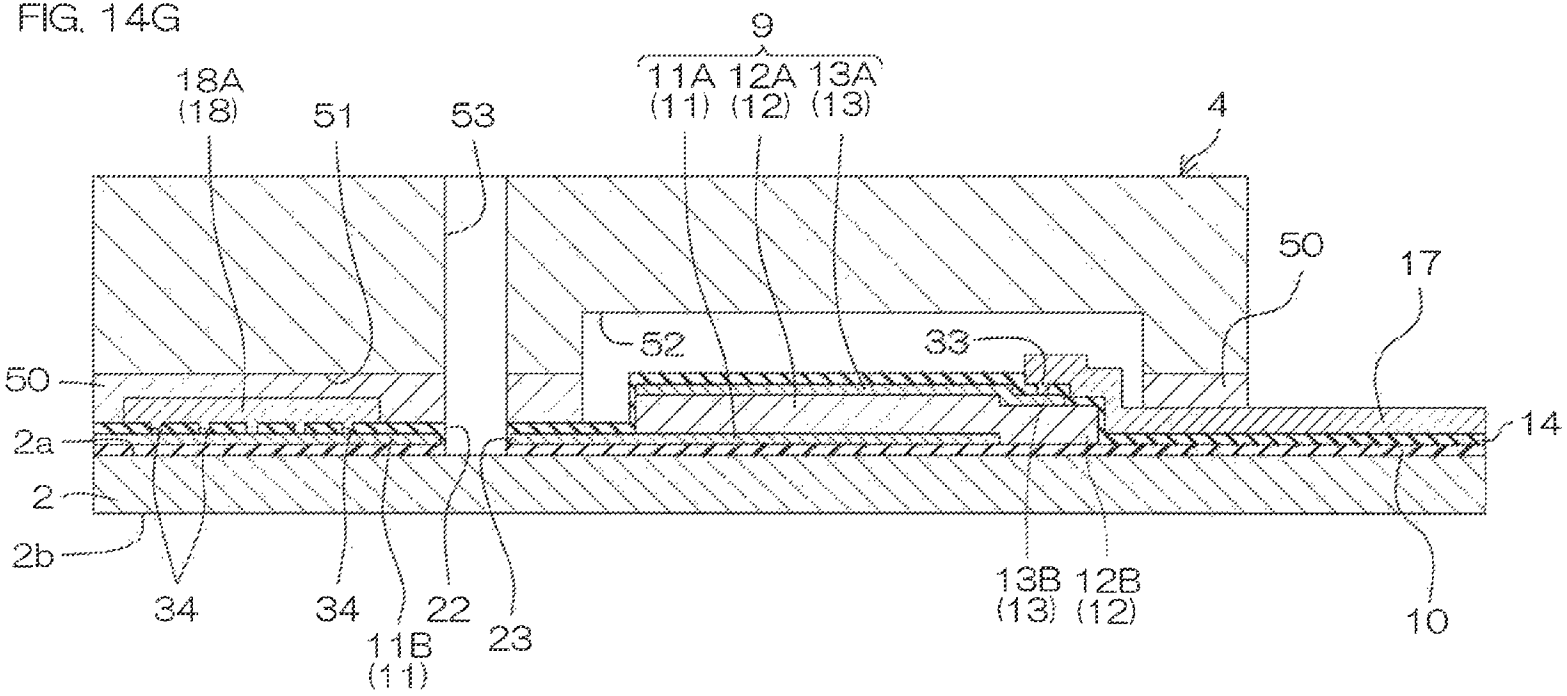
FIG. 14G is a sectional view of a step subsequent to that of FIG. 14F.

Next, as shown in FIG. 14G, the adhesive 50 is coated onto the facing surface 51 of the protective substrate 4 and the protective substrate 4 is fixed onto the actuator substrate 2 so that the ink supply passages 53 and the ink supply penetrating holes 22 are matched.

Figure 14H:
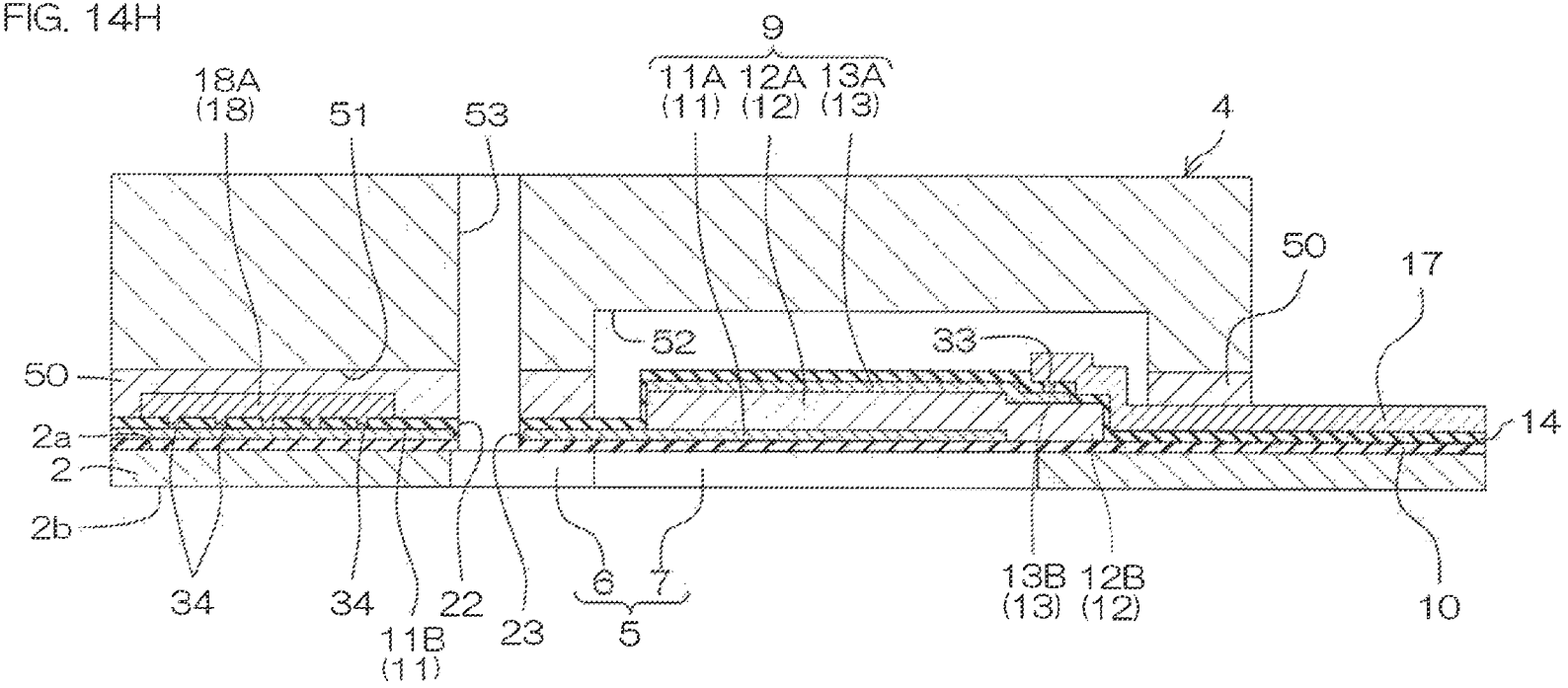
FIG. 14H is a sectional view of a step subsequent to that of FIG. 14G.

Next, as shown in FIG. 14H, rear surface grinding for thinning the actuator substrate 2 is performed. The actuator substrate 2 is made thin by the actuator substrate 2 being ground from the rear surface 2*b*. For example, the actuator substrate 2 with a thickness of approximately 670 μm in the initial state may be thinned to a thickness of approximately 300 μm. Next, etching (dry etching or wet etching) from the rear surface of the actuator substrate 2 is performed on the actuator substrate 2 to form the ink flow passages 5 (the ink inflow portions 6 and the pressure chambers 7).

In the etching process, the base oxide film formed on the front surface of the movable film formation layer 10 prevents the escaping of metal elements (Pb, Zr, and Ti in the case of PZT) from the piezoelectric film 12 and keeps the piezoelectric characteristics of the piezoelectric film 12 in a satisfactory state. Also as mentioned above, the base oxide film formed on the front surface of the movable film formation layer 10 contributes to maintaining the durability of the silicon layer that forms each movable film 10A.

Figure 14I:
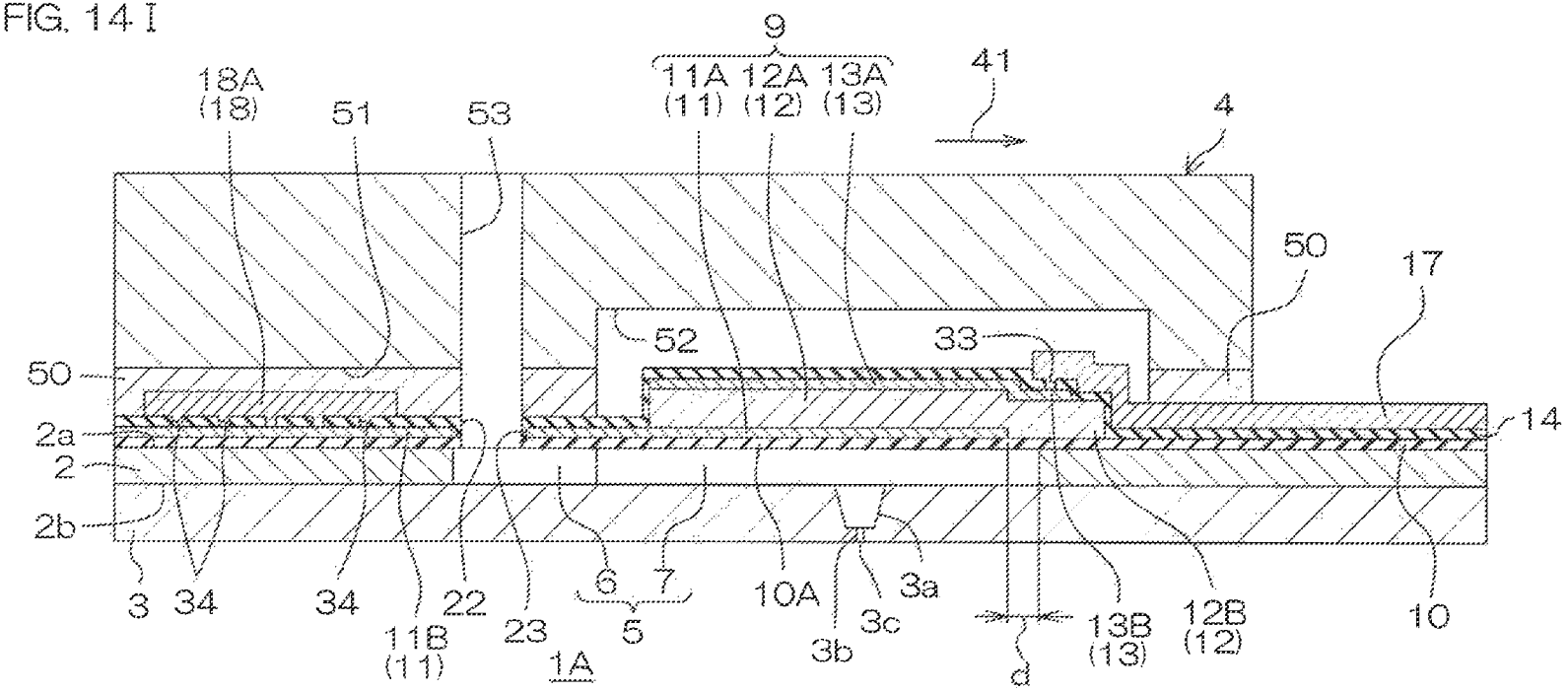
FIG. 14I is a sectional view of a step subsequent to that of FIG. 14H.

Thereafter, as shown in FIG. 14I, the nozzle substrate 3 is adhered onto the rear surface of the actuator substrate 2 and the inkjet printing head 1A is thereby obtained.

With the second preferred embodiment described above, the upper wirings 17 arranged to connect the upper electrodes 13 to the drive circuit are constituted from one type of wiring. Similarly, the lower wiring 18 arranged to connect the lower electrode 11 to the drive circuit is also constituted from one type of wiring. Therefore, in comparison to the inkjet printing head according to the reference example, processes for forming the upper wirings and the lower wiring are made simple. Manufacture of the inkjet printing head is thus made simple in comparison to the inkjet printing head according to the reference example. Also, with the second preferred embodiment, an insulating film and a passivation film are not provided and the manufacture of the inkjet printing head is thus made simpler.

Although the first and second preferred embodiments of the present invention have been described above, the present invention may be implemented in yet other preferred embodiments. Although in the first preferred embodiment described above, the insulating film 15 is formed on a portion of the front surface of the hydrogen barrier film 14, the insulating film 15 may instead be formed on the entirety of the front surface of the hydrogen barrier film 14.

Also, although in each of the first and second preferred embodiments described above, PZT was cited as an example of the material of the piezoelectric film, a piezoelectric material besides this that is constituted of a metal oxide as represented by lead titanate ($PbPO_3$), potassium niobate ($KNbO_3$), lithium niobate ($LiNbO_3$), lithium tantalate ($LiTaO_3$), etc., may be applied instead.

Also, although with each of the first and second preferred embodiment described above, a case where the present invention is applied to an inkjet printing head was described, the present invention may also be applied to a piezoelectric microphone, pressure sensor, etc., that uses a piezoelectric element.

The present application corresponds to Japanese Patent Application No. 2015-204694 filed on Oct. 16, 2015 in the Japan Patent Office, and the entire disclosure of this application is incorporated herein by reference.

While preferred embodiments of the present invention have been described above, it is to be understood that variations and modifications will be apparent to those skilled in the art without departing the scope and sprit of the present invention. The scope of the present invention, therefore, is to be determined solely by the following claims.

What is claimed is:

1. A device using a piezoelectric element comprising:

a cavity;

a movable film formation layer including a movable film disposed above the cavity and defining a top surface portion of the cavity;

a piezoelectric element formed above the movable film, and including a lower electrode formed above the movable film, a piezoelectric film formed above the lower electrode, and an upper electrode formed above the piezoelectric film, the lower electrode including a main electrode portion constituting the piezoelectric element and an extension portion led out from the main electrode portion in a direction along a front surface of the movable film formation layer;

a hydrogen barrier film, covering entireties of side surfaces of the upper electrode and the piezoelectric film, at least a portion of an upper surface of the upper electrode, and at least a portion of an upper surface of the lower electrode;

an insulating film, formed above the hydrogen barrier film;

an upper wiring, made of gold, formed above the insulating film, and arranged to connect the upper electrode to a drive circuit; and a lower wiring, made of gold, formed above the insulating film, and arranged to connect the lower electrode to the drive circuit;

wherein a first contact hole, exposing a portion of the upper electrode, and a second contact hole, exposing a portion of the extension portion, are formed in the hydrogen barrier film and the insulating film;

the upper wiring being connected to the upper surface of the upper electrode via the first contact holes;

the lower wiring being connected to the upper surface of the extension portion via the second contact hole;

the upper electrode having, in a plan view of viewing from a direction normal to a major surface of the movable film, a peripheral edge that is receded further toward an interior of the cavity than the movable film;

the upper wiring having, in the plan view, one end portion connected to the upper surface of the upper electrode and another end portion led out to an outer side of a top surface portion peripheral edge of the cavity;

the extension portion being led out from the main electrode portion in a direction along a front surface of the movable film formation layer and, in the plan view of viewing from the direction normal to the major surface of the movable film, extending across the top surface portion peripheral edge of the cavity to outside the cavity; and the lower wiring being electrically connected to an upper surface of an outer electrode region of the extension portion that is located further outward than the top surface portion peripheral edge of the cavity.

2. The device using the piezoelectric element according to claim 1, wherein the piezoelectric film is constituted of a PZT film.

3. The device using the piezoelectric element according to claim 1, wherein the upper electrode is constituted of a Pt single film.

4. The device using the piezoelectric element according to claim 1, wherein the upper electrode is constituted of a laminated film of an $IrO_2$ film formed above the piezoelectric film and an Ir film formed above the $IrO_2$ film.

5. The device using the piezoelectric element according to claim 1, wherein the lower electrode is constituted of a laminated film of a Ti film formed at the movable film side and a Pt film formed above the Ti film.

6. A device using a piezoelectric element, comprising:

a cavity;

a movable film formation layer including a movable film disposed above the cavity and defining a top surface portion of the cavity;

a piezoelectric element formed above the movable film, and including a lower electrode formed above the movable film, a piezoelectric film formed above the lower electrode, and an upper electrode formed above the piezoelectric film, the lower electrode including a main electrode portion constituting the piezoelectric element and an extension portion led out from the main electrode portion in a direction along a front surface of the movable film formation layer;

a hydrogen barrier film, covering entireties of side surfaces of the upper electrode and the piezoelectric film, at least a portion of an upper surface of the upper electrode, and at least a portion of an upper surface of the lower electrode;

an insulating film, formed above the hydrogen barrier film;

an upper wiring, made of gold, formed above the insulating film, and arranged to connect the upper electrode to a drive circuit; and a lower wiring, made of gold, formed above the insulating film, and arranged to connect the lower electrode to the drive circuit;

wherein a first contact hole, exposing a portion of the upper electrode, and a second contact hole, exposing a portion of the extension portion, are formed in the hydrogen barrier film and the insulating film;

the upper wiring being connected to the upper surface of the upper electrode via the first contact hole;

the lower wiring being connected to the upper surface of the extension portion via the second contact hole;

the top surface portion of the cavity being, in the plan view, a rectangle that is long in one predetermined direction;

the upper electrode being, in the plan view, a rectangle that is long in the one direction and has a width shorter than a width in a short direction of the top surface portion of the cavity and a length shorter than a length in a long direction of the top surface portion of the cavity, with both end edges and both side edges thereof being respectively receded further toward the interior of the cavity than both end edges and both side edges of the top surface portion of the cavity;

each of the piezoelectric film and the main electrode portion having a shape of the same pattern as the upper electrode in the plan view;

the extension portion extending from a peripheral edge of the main electrode portion, across the top surface portion peripheral edge of the cavity, to outside the top surface portion peripheral edge;

the upper wiring extending, in the plan view, from an upper surface of one end portion of the upper electrode to an outer side across a corresponding one end portion of the top surface portion of the cavity; and the lower wiring including, in the plan view, a base portion, disposed at an outer side of another end portion of the top surface portion of the cavity, and a lead portion, extending from the base portion and along one side portion of the top surface portion of the cavity and thereafter extending parallel to the upper wiring.

7. A device using a piezoelectric element, comprising:

a cavity;

a movable film formation layer including a movable film disposed above the cavity and defining a top surface portion of the cavity;

a piezoelectric element formed above the movable film, and including a lower electrode formed above the movable film, a piezoelectric film formed above the lower electrode, and an upper electrode formed above the piezoelectric film, the lower electrode including a main electrode portion constituting the piezoelectric element and an extension portion led out from the main electrode portion in a direction along a front surface of the movable film formation layer;

a hydrogen barrier film, covering entireties of side surfaces of the upper electrode and the piezoelectric film, at least a portion of an upper surface of the upper electrode, and at least a portion of an upper surface of the lower electrode;

an insulating film, formed above the hydrogen barrier film;

an upper wiring, made of gold, formed above the insulating film, and arranged to connect the upper electrode to a drive circuit; and a lower wiring, made of gold, formed above the insulating film, and arranged to connect the lower electrode to the drive circuit;

wherein a first contact hole, exposing a portion of the upper electrode, and a second contact hole, exposing a portion of the extension portion, are formed in the hydrogen barrier film and the insulating film;

the upper wiring being connected to the upper surface of the upper electrode via the first contact hole; and the lower wiring being connected to the upper surface of the extension portion via the second contact hole; and the movable film formation layer being constituted of an $SiO_2$ single film.

8. A device using a piezoelectric element, comprising:

a cavity;

a movable film formation layer including a movable film disposed above the cavity and defining a top surface portion of the cavity;

a piezoelectric element formed above the movable film, and including a lower electrode formed above the movable film, a piezoelectric film formed above the lower electrode, and an upper electrode formed above the piezoelectric film, the lower electrode including a main electrode portion constituting the piezoelectric element and an extension portion led out from the main electrode portion in a direction along a front surface of the movable film formation layer;

a hydrogen barrier film, covering entireties of side surfaces of the upper electrode and the piezoelectric film, at least a portion of an upper surface of the upper electrode, and at least a portion of an upper surface of the lower electrode;

an insulating film, formed above the hydrogen barrier film;

an upper wiring, made of gold, formed above the insulating film, and arranged to connect the upper electrode to a drive circuit; and a lower wiring, made of gold, formed above the insulating film, and arranged to connect the lower electrode to the drive circuit;

wherein a first contact hole, exposing a portion of the upper electrode, and a second contact hole, exposing a portion of the extension portion, are formed in the hydrogen barrier film and the insulating film;

the upper wiring being connected to the upper surface of the upper electrode via the first contact hole;

the lower wiring being connected to the upper surface of the extension portion via the second contact hole; and the movable film formation layer being constituted of a laminated film of an Si film formed above the substrate, an $SiO_2$ film formed above the Si film, and an SiN film formed above the $SiO_2$ film.

* * * * *